United States Patent [19]

Rickert

[11] 4,003,968

[45] Jan. 18, 1977

[54] CHARGE FORMING METHOD AND APPARATUS

[75] Inventor: Paul E. Rickert, Oregon, Ohio

[73] Assignee: Borg-Warner Corporation, Chicago, Ill.

[22] Filed: Oct. 31, 1975

[21] Appl. No.: 627,871

Related U.S. Application Data

[63] Continuation of Ser. No. 365,960, June 1, 1973, abandoned.

[52] U.S. Cl. ..... 261/35; 261/41 D; 261/72 R; 261/121 A; 261/DIG. 57; 261/DIG. 68; 417/380; 417/497

[51] Int. Cl.[2] ..... F02M 17/04

[58] Field of Search ..... 261/DIG. 68, DIG. 57, 261/34 R, 72 R, 121 A, 121 B, 71, 41 D, 35; 239/555; 417/380, 479

[56] References Cited

UNITED STATES PATENTS

| | | | |
|---|---|---|---|
| 1,251,570 | 1/1918 | Pradier | 261/DIG. 57 |
| 2,685,916 | 8/1954 | Martt | 239/555 |
| 2,713,894 | 7/1955 | Sage | 239/555 |
| 2,841,372 | 7/1958 | Phillips | 261/DIG. 68 |
| 2,892,622 | 6/1959 | Goodyear | 261/72 R |
| 2,973,947 | 3/1961 | Sterner | 261/72 R |
| 3,170,006 | 2/1965 | Brown | 261/DIG. 68 |
| 3,188,060 | 6/1965 | Kalert, Jr. | 261/72 R |
| 3,231,250 | 1/1966 | Kalert, Jr. | 261/72 R |
| 3,233,878 | 2/1966 | Phillips | 261/DIG. 68 |
| 3,253,822 | 5/1966 | Arndt et al. | 261/DIG. 68 |
| 3,275,306 | 9/1966 | Phillips | 261/DIG. 68 |
| 3,278,172 | 10/1966 | Meininger | 261/DIG. 68 |
| 3,288,446 | 11/1966 | Bimberg | 261/68 |
| 3,314,371 | 4/1967 | Hopkinson | 417/479 |
| 3,409,277 | 11/1968 | Reise | 261/71 |
| 3,593,967 | 7/1971 | Nutten | 261/DIG. 68 |
| 3,612,397 | 10/1971 | Pearson | 239/555 |
| 3,738,623 | 6/1973 | Tuckey | 261/DIG. 68 |
| 3,743,253 | 7/1973 | Tuckey et al. | 261/DIG. 68 |
| 3,743,254 | 7/1973 | Tuckey | 261/DIG. 68 |
| 3,807,707 | 4/1974 | Johnson | 261/23 A |

*Primary Examiner*—Tim R. Miles
*Attorney, Agent, or Firm*—Harry O. Ernsberger

[57] ABSTRACT

The disclosure embraces a charge forming apparatus or carburetor and method of operation thereof wherein the charge forming apparatus is of modular construction and is inclusive of a body construction and a fluid flow control construction associated with the body construction, the fluid flow control construction being of laminar character fashioned with open areas or passages accommodating fluid flow or transfer, the fluid flow control being of a character enabling the interchangeability of fluid flow control laminations having different or modified patterns or arrangements of open areas or passages whereby the method of operation or the operating or metering characteristics of the charge forming apparatus may be changed or modified without alteration of the body construction. The provision of interchangeable fluid flow control laminations or members facilitates standardization of the body whereby the standardized charge forming apparatus may be rendered usable with engines of different sizes and operating characteristics by employing a fluid flow control construction having a selected orientation of open areas or passages accommodating fluid flow.

24 Claims, 45 Drawing Figures

CHARGE FORMING METHOD AND APPARATUS

This application is a continuation of my copending application, Ser. No. 365,960, filed June 1, 1973, now abandoned.

The invention relates to a charge forming method and charge forming apparatus or carburetor associated with or embodying a fluid flow control construction having fluid-conveying open areas or passages and wherein fuel inlet valve means controlled by a diaphragm influenced by engine aspiration or by a float-controlled arrangement provides regulated fuel flow to the fluid flow control construction.

Carburetors of the aspirated diaphragm type have come into extensive use for supplying fuel and air mixtures to engines of the two cycle type for operating or powering chain saws, lawnmowers, marine engines, earth tampers, snowmobiles, reciprocating hammers and similar engine-driven instrumentalities. Carburetors of the float-controlled fuel regulating type are usable with engines of both two cycle and four cycle types such as automotive engines and other engines wherein the carburetor is not usually subjected to severe tilt during operation.

It has been a usual practice to die cast the metal carburetor body with the fuel and air channels cast therein and, when it is necessary to change the channels or passages to accommodate the carburetor to a particular engine, a new carburetor body of similar over-all dimensions must be cast and hence an entirely new die casting must be made with the desired cast-in channels or passageways. Dies for casting carburetor bodies of both the diaphragm type and float-controlled type are expensive, usually costing several thousands of dollars, and in order to provide carburetors for various size engines it has been heretofore necessary to carry substantial inventory of carburetor bodies having different fuel and air channels cast therein in order to provide the proper calibration of fuel and air mixture for various size engines or having different operating characteristics.

Carburetor constructions of the aspirated diaphragm type are usually inclusive of diaphragm type fuel pump construction, such construction providing a unitary compact arrangement particularly advantageous for use with two cycle engines. Such pump construction includes a pump plate or pump body secured to a carburetor body with a pumping diaphragm and pump valve means disposed between the carburetor body and the pump plate.

Heretofore, the pump plate has been configurated with a pulsing or pumping chamber and recesses to accommodate movement of flap-type valves controlling fuel flow through the pump. The pumping diaphragm is activated by varying pressures or pulsations from the crankcase of a two cycle engine. Thus, the pump plate or pump body in prior constructions involved the fabrication of an expensive die for making the pump plate. Furthermore, the pump plate of prior constructions required drilling passages for transmitting the pulsations or varying pressures in the engine crankcase to the pumping region of the pumping diaphragm.

The present invention embraces a method of providing a fuel and air mixture in a charge forming apparatus or carburetor involving a method of fluid flow control utilizing a control of laminar character having a selected orientation of open areas or passages accommodating flow of fluid, and interchanging laminar controls having different orientations of open areas or passages for modifying fluid flow paths in a charge forming apparatus or carburetor.

Another object of the invention resides in a method of modifying the metering system for providing a fuel and air mixture for a charge forming apparatus including controlling the path of fuel flow through open areas or passages in a fluid flow control arrangement, and interchanging one flow control arrangement for another having different orientation of open areas or passages for modifying the path of flow of the fuel.

Another object of the invention resides in a method of modifying the metering system for a change forming apparatus including a fluid flow control arrangement having open areas or air bypass or air bleed passages controlling the path of flow of air for admixing with fuel for delivery into the mixing passage, and interchanging one fluid flow control arrangement for another having a different orientation of open areas or passages for modifying the path of flow of the air.

Another object of the invention resides in a method for calibrating a carburetor to modify the metering system of a carburetor having a modular body construction fashioned with a mixing passage including an air induction zone and a fuel dispersion zone, controlling the flow paths of fuel and air through open areas in a fluid flow control assembly associated with the body construction, and interchanging one control assembly for another having a different orientation of open areas for modifying the metering characteristics of the carburetor.

Another object of the invention embraces a charge forming apparatus or carburetor construction comprising a modular body construction and fluid flow control means associated with the body construction, the control means being fashioned with open areas providing fluid flow passages or channels for controlling paths of fluid flow, the control means being of laminate character which may be replaced or interchanged with another control means provided with a different orientation of open areas for modifying the flow paths of fluids whereby to accommodate the carburetor construction to different internal combustion engines by the expedient of interchanging control means.

Another object of the invention is the provision of a diaphragm type carburetor having a modular body construction and a fluid flow control means, plate or laminate means associated with the body construction whereby the control means having a particular orientation of fluid flow control openings or passages is interchangeable with other fluid flow control means having different orientations of fluid control openings or passages rendering the carburetor adaptable to various calibrations by the expedient of interchanging fluid flow control means and without modifying the body construction of the carburetor.

Another object of the invention resides in a carburetor body construction associated with fluid flow control means of laminar character, the body construction having a predetermined orientation or pattern of fluid flow passages, the fluid flow control means being selected from several control means wherein each is provided with a different orientation or perforate pattern portion or region of open area or passages accommodating fluid flow whereby interchanging one flow control means for another facilitates modifying the fluid flow paths by utilization of a selected control means which may have open areas registering with certain passages in a carburetor body construction and regions closing other passages in the body construction thereby rendering the carburetor usable with various engines requiring different carburetor metering characteristics yet utilizing the same carburetor body construction.

Another object of the invention is the provision of a carburetor embodying die cast body construction associated with interchangeable fluid flow control means wherein a selected flow control means having a desired orientation of open areas or passages for conveying fluids may be employed with the body whereby identical die cast bodies may be utilized to secure various fluid flow meterings for different engines without modification of the die cast body.

Another object of the invention embraces a charge forming apparatus or carburetor having a body member and a fluid flow control means associated with the body member, the control means being fashioned with open areas providing passages or channels for conveying liquid fuel and air, the fluid flow control means receiving fuel from a chamber in which the fuel level is regulated by float-controlled valve means.

A further object of the invention is the provision of a combined carburetor and diaphragm fuel pump construction wherein a planar pump body is assembled with a carburetor body construction, a pumping diaphragm and a laminate or plate, the latter having open areas, chambers or cavities accommodating flexing movements or a pulsing or pumping diaphragm and movements of the fuel control valves.

Another object of the invention resides in a carburetor construction wherein a body component or body member of the carburetor is fashioned with a fuel and air mixing passage embodying a removable Venturi construction to enable the use of interchangeable Venturi constructions of different sizes to render the carburetor usable with different capacity engines without modifying the carburetor body component.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

Figure 44:
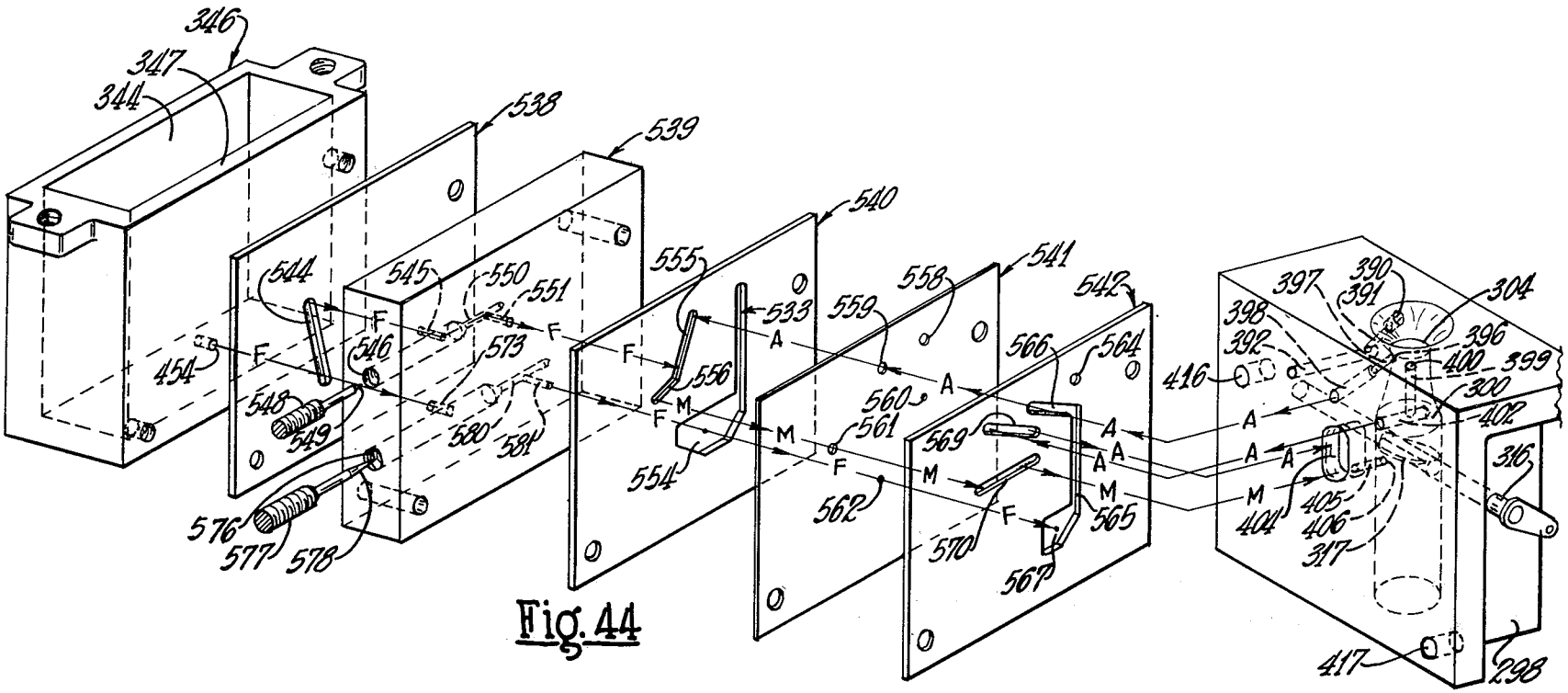
Figure 45:
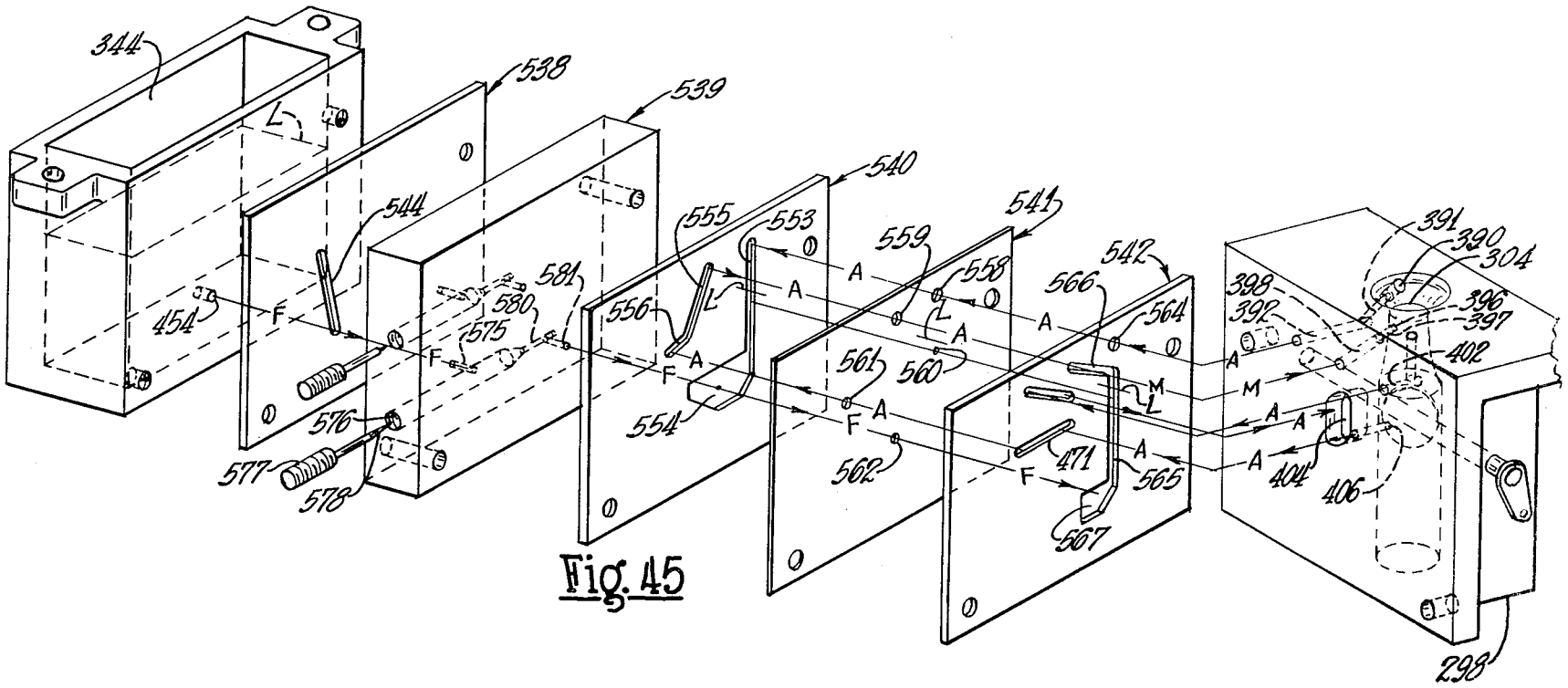

FIG. 44 is an isometric view of components of the fluid flow control construction shown in expanded relation illustrating paths of fluid flow in an independent system during engine idling operation; and FIG. 45 is an isometric view of components of the fluid flow control construction shown in expanded relation illustrating paths of fluid flow in an independent system during high speed engine operation.

One form of the carburetor construction and the fluid flow control system may be of a character wherein an engine aspirated diaphragm regulates fuel flow from a supply to the fluid flow control system, and another form of the carburetor construction and fluid flow control system or arrangement may be of a character wherein float-controlled means regulates fuel flow to the fluid flow control system, both forms of the invention being illustrated and described.

The carburetor construction of the aspirated diaphragm type and associated fluid flow control system and apparatus are illustrated in FIGS. 1 through 29. Referring to the drawings in detail and initially to FIGS. 1 through 8, the charge forming apparatus or carburetor of the diaphragm aspirated type is inclusive of a body construction 10 comprising a main body or body component or member 11 and a second or supplemental body, component or member 12. Disposed between the carburetor body components 11 and 12 is a fluid flow control means including a component, laminar member, laminate or plate 14. The laminate or member 14 is fashioned with open areas, perforate pattern regions, slots or passages for conveying, accommodating and controlling fluid flow.

The invention embraces the utilization of interchangeable laminates, laminar members or components 14, each having a different pattern or orientation of perforations, open areas or passages for use with the body components or members 11 and 12 whereby different calibrations or metering systems for the carburetor or charge forming apparatus may be attained without modifying the body components by interchanging control laminates or members 14.

The perforate pattern regions or orientations of open areas or passages in various interchangeable fluid flow control laminates or members 14 are of a character wherein in one assembly certain fluid passages or open areas register with passages or channels in the body construction and, in other installations certain of the perforate pattern regions, open areas or passages in the control laminates or members may be blocked off depending upon the particular use, metering system and calibration of the carburetor and upon the operating characteristics and requirements of an internal combustion engine with which the carburetor may be used.

While several interchangeable fluid flow control components, laminar members, laminates or plates are herein disclosed and will be hereinafter described in detail, it is to be understood that fluid flow control components, laminar members, laminates or plates provided with other perforate pattern regions or orientations of open areas or passages may be utilized.

The carburetor body components or members 11 and 12 are preferably fashioned as die castings of metal, but is is to be understood that the bodies may be of resinous plastic or other suitable material. The main body 11 of the carburetor 10 is fashioned with a fuel and air mixing passage 17, the passage including an air inlet region or air induction zone 18 defined by a cylindrical wall 19, a mixture outlet region 21 defined by a cylindrical wall 22, and a means or member 24 shaped to provide a Venturi or Venturi configuration 26 having a choke band region 27 or region of minimum diameters.

Figure 8:
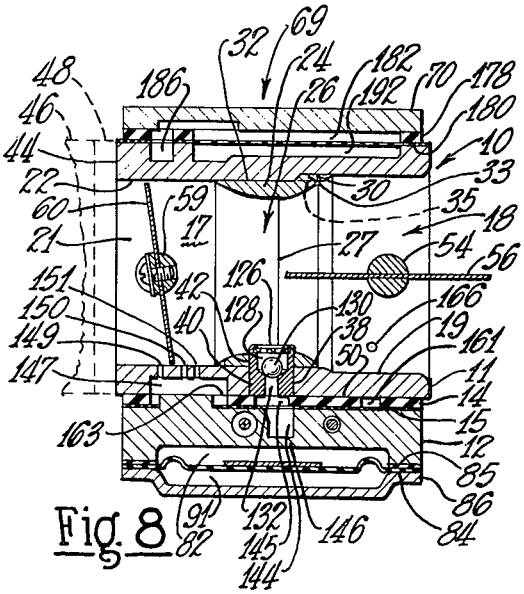
FIG. 8 is a longitudinal sectional view taken substantially on the line 8—8 of FIG. 7.

In the embodiment illustrated in FIG. 8, the diameter of the cylindrical surface 19 defining the air inlet region 18 is slightly larger than the diameter of the cylindrical wall 22, the cylindrical wall surfaces 19 and 22 being joined by a tapered or frusto-conical surface 30. The member 24 is made removable so that another member 24 having a different diameter Venturi 26 may be utilized thereby providing a means for changing or varying the flow capacity of the Venturi so as to enable the use of the carburetor construction with engines of different horsepower.

Figures 1, 2, 3, 4, 5, 10, 11, 12, 13, 14, 15:
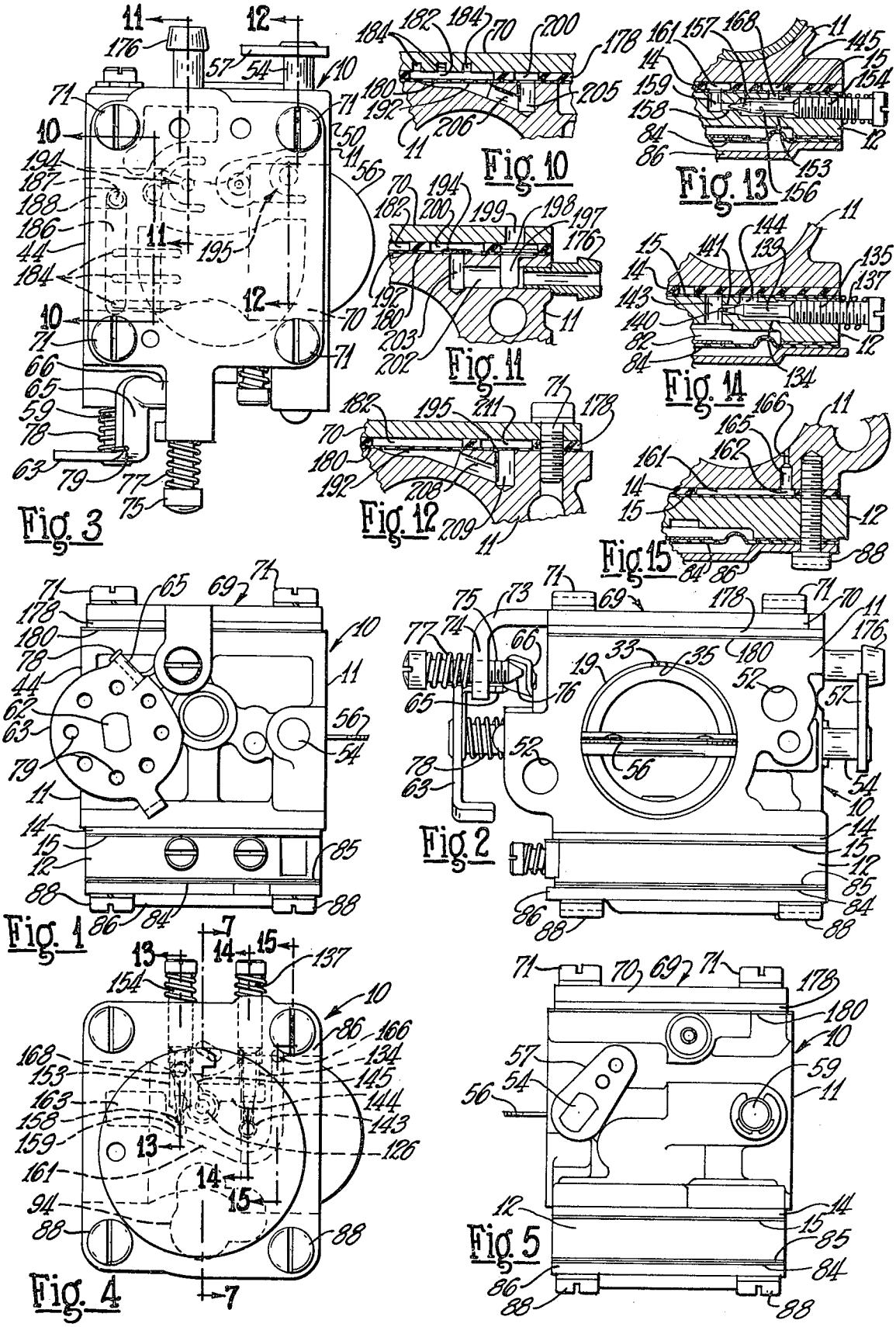
FIG. 1 is a side elevational view of a carburetor and fuel pump construction embodying the invention.
FIG. 2 is an elevational view of the air inlet end of the construction shown in FIG. 1.
FIG. 3 is a top plan view of the carburetor and fuel pump construction.
FIG. 4 is a bottom plan view of the construction shown in FIG. 1.
FIG. 5 is an elevational view of the opposite side of the carburetor and fuel pump construction.
FIG. 10 is a fragmentary sectional view taken substantially on the line 10—10 of FIG. 3.
FIG. 11 is a fragmentary detail sectional view taken substantially on the line 11—11 of FIG. 3.
FIG. 12 is a fragmentary detail sectional view taken substantially on the line 12—12 of FIG. 3.
FIG. 13 is a fragmentary detail sectional view taken substantially on the line 13—13 of FIG. 4.
FIG. 14 is a fragmentary detail sectional view taken substantially on the line 14—14 of FIG. 4.
FIG. 15 is a fragmentary detail sectional view taken substantially on the line 15—15 of FIG. 4.

The exterior cylindrical surface 32 of the member 24 is of a diameter so that member 24 is snugly fitted with the cylindrical surface 32 in the body 11 but may be removed by pressure and a different Venturi member inserted. As shown in FIGS. 2 and 8, the Venturi member 24 is fashioned with a projection or lug 33 which is adapted to fit into a recess or notch 35 provided in the carburetor body component 11 for properly aligning the member 24 in the mixing passage region of the body component.

A wall of the carburetor body component 11 is fashioned with a bore 38 into which is press fitted a member or fitting 40, the latter providing a main orifice construction and hereinafter further described. The fitting 40, as shown in FIG. 8, extends into a transverse bore 42 formed in the Venturi member 24. The positioning of the member 24 in the mixing passage with the lug 33 engaged in the notch or recess 35 effects registration of the bore 42 with the bore 38 so that the fitting 40 is properly accommodated in the bore 42, the projection of the fitting 40 into the bore 42 serving to retain the member 24 in its proper position in the mixing passage.

The mixture outlet end of the carburetor body component 11 is fashioned with a uniplanar surface 44 which is adapted to be attached to a boss portion 46 indicated in broken lines which may be a boss portion on the crankcase of a two cycle engine, or a boss portion on the engine cylinder of a two cycle engine of the three port type with a heat insulating gasket 48, shown in broken lines, interposed between the planar surface 44 and the boss 46. Where the carburetor is utilized on a reed valve type of a two cycle engine, a reed valve construction (not shown) may be disposed between the heat insulating gasket or member 48 and the boss portion 46.

The mixture outlet 21 registers with openings in the gasket 48 and the boss portion 46 for delivering air and fuel mixture into the engine crankcase of a two cycle engine or to a mixture intake manifold of an engine of the four cycle type. The air inlet end of the body component 11 is fashioned with a planar surface 50 to which may be fitted an air filter or air cleaner (not shown) of conventional construction. The body component 11 is fashioned with cylindrical passages or bores 52 extending through the body and accommodating bolts (not shown) for securing the carburetor body 11 and heat insulating gasket 48 in assembly with the engine crankcase or cylinder wall.

Extending across the air inlet region 18 and journaled in bores provided in the body 11 is a shaft 54 supporting a disc-type choke valve 56. One end of the shaft 54 extending exteriorly of the body 11 is provided with a manipulating arm 57 for opening and closing the choke valve 56 in a conventional manner.

Extending across the mixture outlet region 21 and journaled in bores provided in the body 11 is a shaft 59 supporting a disc-type throttle valve or throttle plate 60. The throttle shaft 59 is provided with a noncircular portion 62 on which is fixedly mounted a disc-like member 63. The disc-like member 63 is fashioned with an arm portion 65 extending toward the carburetor body, the arm portion terminating in a projection 66 particularly shown in FIGS. 1 through 3 and 6.

The carburetor construction is inclusive of a fuel pump construction 69 having a pump body or pump plate 70 secured to the carburetor body component 11 by screws 71, the pump construction being hereinafter described. As particularly shown in FIGS. 1 through 3 and 6, the pump plate 70 is provided with an L-shaped projection 73, a depending portion 74 of the projection 73 having a threaded bore accommodating an adjusting screw 75. A cone-shaped portion 76 of the adjusting screw engages the projection 66 on the arm 65.

By manipulating the adjusting screw 75, the cone-shaped portion 76 cooperates with the projection 66 on the disc 63 for adjusting or regulating the near closed or engine idling position of the throttle valve 60, a coil spring 77 frictionally retaining the screw 75 in adjusted position. A coil spring 78 surrounds a portion of the throttle shaft as shown in FIGS. 2 and 3, one end (not shown) engaging a lug on the carburetor body component 11, the other end 79 of the spring engaging the arm 65 for resiliently biasing the throttle valve 60 toward closed position.

The disc-like member 63 mounted on the throttle shaft 59 is provided with a plurality of openings 79 to selectively accommodate a manipulating rod (not shown) for actuating or controlling the position of the throttle valve 60 for controlling engine speed above engine idling speed.

The carburetor body member 12 is of a character supporting or mounting certain components of the carburetor construction including the fluid flow control laminar means or member 14 having perforate pattern regions providing fluid flow or metering channels or passages disposed between the carburetor body components 11 and 12 as illustrated in FIGS. 1 through 8. The fluid flow control laminar means or member 14 is of planar or disc-like character having perforate pattern regions, open areas or passages of sizes and shapes to accommodate flow of fluids, such as fuel or air or both to various delivery or discharge orifices or for connection with air bleed or air bypass channels or passages in the carburetor body component or components.

Figure 16:
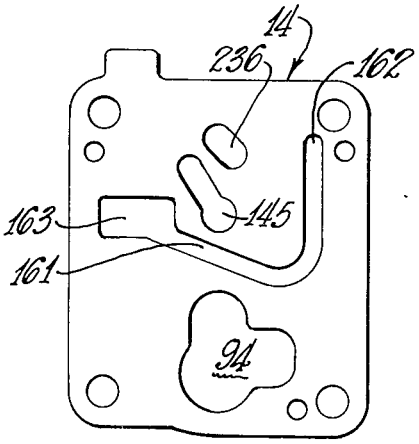
FIG. 16 is a plan view illustrating one form of fluid flow control component illustrating one pattern or configuration of open areas or passages accommodating fluid flow.

The component or laminate 14 is of appreciable thickness to provide fluid flow or metering channels or passages for the conveyance and distribution of fluids. One form of flow control laminate 14 is illustrated in FIG. 16, the laminate being fashioned with perforate pattern regions, perforations, slots or passages having particular configurations for accommodating flow of fluids for the metering or carburetor operation desired for a particular internal combustion engine. The flow control laminate 14 being of planar or laminate construction may be formed by die punching from a sheet of suitable material.

Figure 7:
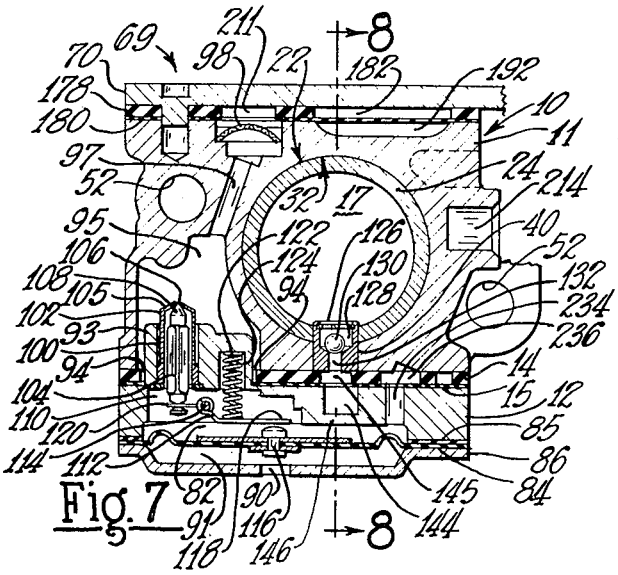
FIG. 7 is a sectional view through the carburetor and fuel pump construction, the view being taken substantially on the line 7—7 of FIG. 4.
Figure 9:
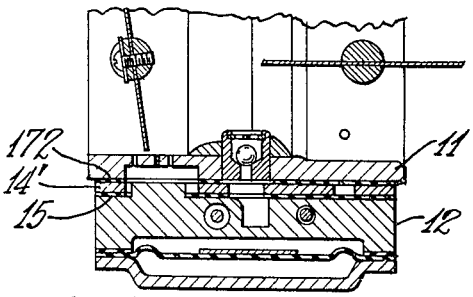
FIG. 9 is a fragmentary view similar to FIG. 8 showing a modified arrangement.

The member 14 may be of material resistant to deterioration by hydrocarbon fuels such as fibrous or other gasket material, semihard synthetic rubber, resinous plastic material such as Mylar (a condensation reaction product of terephthalic acid and ethylene glycol), Teflon (polytetrafluoroethylene) or suitable metals such as copper, brass, aluminum or stainless steel. Where metals are used it may be desirable to use thin sealing members or gaskets at either side of the fluid flow control member as shown in FIG. 9, the sealing members or gaskets being of conventional gasket material. It is found desirable to employ at least one sealing gasket 15, as shown in FIGS. 7 and 8, contiguous with one major surface of the laminar member 14 irrespective of the material of the member 14.

The gasket or gaskets 15 have substantially the same perforate pattern region or orientation of open areas, slots or passages as the perforate pattern region or orientation of open areas, slots or passages in the fluid flow control component or components with which the gasket or gaskets may be used.

In order to adapt the carburetor to various engines and operating conditions where it is necessary to change the metering of fluids, a different laminar means or member 14 may be used, and interchangeable laminar means or members 14 having perforate pattern regions or open areas of different configurations or sizes employed with the carburetor body components or members 11 and 12 without necessitating any major modification of the body members. Many different laminar members 14 which are interchangeable may be fashioned with various configurations of perforations or open areas and the members fabricated by suitable punching dies.

Thus, the metering and operating characteristics of the carburetor may be changed simply by interchanging one laminar means or member 14 for another. In addition to the form shown in FIG. 16, several additional forms of fluid flow control laminar members are illustrated in FIGS. 19 through 22 and 23 through 26 which will be hereinafter described.

The body member or component 12 is formed with a generally circular shallow recess providing a fuel chamber or cavity 82 containing fuel for delivery to the fluid flow control laminar means 14. A flexible member, membrane or diaphragm 84 extending across the recess forms one wall of the fuel chamber 82. A sealing gasket 85 is disposed between the diaphragm 84 and the body 12. A cover member 86 is disposed beneath the diaphragm 84, the cover member engaging the peripheral region of the diaphragm.

The cover member 86, diaphragm 84, gasket 85, body component 12, gasket 15 and the fluid flow component 14 are provided with registering openings to accommodate screws 88 which are engaged in threaded openings in the carburetor body component 11 to secure these elements in assembled relation. The cover member 86 has a depressed central region, as shown in FIGS. 5, 7 and 8, beneath the diaphragm 84, providing a space 91 to accommodate flexing movements of the diaphragm. The cover member 86 has an opening 90 to vent the space 91 at the dry side of the diaphragm to the atmosphere.

The diaphragm or membrane 84 is arranged to be actuated or flexed by aspiration or reduced pressure established in the mixing passage 17 for regulating the flow or delivery of liquid fuel into the diaphragm fuel chamber 82, the fuel chamber 82 being unvented except through the fuel flow channels or passages establishing communication between the fuel chamber 82 and the mixing passage 17.

The body component 12 is fashioned with an upwardly extending portion 93 as shown in FIG. 7, the plate or member 14 having an opening 94 accommodating the portion 93. The body component 11 is fashioned with a recess or surge chamber 95 which accommodates liquid fuel delivered from the diaphragm fuel pump construction 69 through a passage or channel 97 into the surge chamber 95. The surge chamber 95 absorbs or dissipates some energy of momentum of fuel moving past the outlet flap valve 195 of the fuel pump, shown in FIG. 12 and hereinafter described, to promote more smooth flow of fuel into the chamber 95 as well as to increase the flow of fuel through the pump particularly at high frequency vibration of the pumping diaphragm.

A screen or filter 98 is disposed at the entrance of the passage 97 for filtering incoming fuel. The upwardly extending portion 93 is provided with a bore 100 in which is pressed or snugly fitted a tubular member or sleeve 102, the sleeve providing a cage which slidably accommodates an inlet valve or inlet valve body 104.

The upper end of the valve cage 102 is preferably conically shaped as at 105 forming a valve seat, and the apex of portion 105 is provided with a fuel inlet port or passage 106. The valve body 104 is of polygonally-shaped cross section providing facets to facilitate flow of liquid fuel along the valve body into the diaphragm fuel chamber 82. The upper end of the valve body 104 is fashioned with a cone-shaped valve portion 108, the cone-shaped portion controlling or regulating fuel flow through the port 106.

The cone-shaped valve portion 108 may be provided with a coating or film of nonmetallic material, such as resinous plastic, bonded or otherwise joined with the cone-shaped portion. The nonmetallic material has sufficient resilient characteristics so as to readily conform to the valve seat 105 to provide for positive closing of the valve. If desired, the cone-shaped valve portion 108 may be arranged to seat against an annular nonmetallic or snythetic rubber seat (not shown) inserted within the cone-shaped portion 105.

Means are provided whereby movements of the metering diaphragm 84 are communicated to the valve body 104 for controlling the position of the valve body and thereby regulate fuel flow into the fuel chamber 82. The body component 12 is configurated with a recess 110 forming a portion of the fuel chamber 82, the recess accommodating a motion-multiplying means, such as a lever 112, the lever being fulcrumed intermediate its ends on a fulcrum pin 114 mounted by the body component 12. The central region of the diaphragm 84 is equipped with a headed member 116 which extends through registering openings in the diaphragm and reinforcing discs disposed at each side of the diaphragm, the member 116 being swaged to secure the same to the diaphragm 84.

The long arm 118 of the lever 112 is in position for engagement with the head of the member 116. The short arm 120 of the lever is articulately connected with the lower end of the valve body 104 as shown in FIG. 7, the articulate connection comprising a bifurcated portion of the short arm 120 of the lever engaging in a recess provided in the lower end region of the valve body. Through this arrangement a positive articulate connection is established between the lever 112 and the valve body so that upward flexing movements of the diaphragm cause swinging movements of the lever 112 to control the position of the valve body 104.

Resilient means, such as an expansive coil spring 122 nested in a bore or socket 124 formed in the portion 93 of body component 12 engages the long arm 118 of the lever 112, the spring exerting biasing force normally urging the inlet valve 108 toward port-closing position. Aspiration set up in the mixing passage 17 is communicated through fuel passages or channels to the fuel chamber 82 as hereinafter described, the aspiration or reduced pressure elevating the diaphragm 84 by swinging the lever 112 in a counterclockwise direction as viewed in FIG. 7 to withdraw the valve portion 108 from the port 106 to valve in fuel from the surge chamber 95 into the diaphragm fuel chamber 82.

The carburetor mixing passage is inclusive of a fuel dispersion zone comprising a main or primary fuel delivery aperture means or system for delivering or discharing fuel into the Venturi 26 of the mixing passage for intermediate and high speed engine operation, and a secondary or supplemental fuel delivery aperture means or system including supplemental delivery or discharge orifices opening into the mixing passage 17 for engine idling and low speed operation. The main or primary fuel delivery system is inclusive of a main orifice or aperture means 126 which is the outlet of a counterbore 128 in the fitting 40. The counterbore 128 accommodates a ball check valve or member 130 which seats against a ledge at the end of a bore or passage 132 in the fitting 40. The ball check valve or member 130, loosely disposed in the counterbore 128, is prevented from dislodgment by an abutment extending across the outlet providing the main orifice.

Referring to FIG. 14, the body component 12 is fashioned with a bore 134 which has a threaded portion 135 for accommodating the threaded portion of a valve body 137 constituting a high speed adjusting valve member or restrictor. The valve body or member 137 has a tenon portion 139 terminating in a needle valve portion 140 cooperating with a restricted passage 141 which is in communication with a fuel passage or channel 143 which opens into and receives fuel from the fuel chamber 82. As shown in FIGS. 4, 7 and 8, an elongated channel 144 is in communication with a passage 132 in the fitting 40 through an open area, passage or channel 145 in the fluid flow control member 14. Thus, through the channel arrangement shown in FIGS. 4, 7, 8 and 14, fuel is conveyed to the main orifice 126, and the flow rate of fuel regulated by adjusting the valve body 137 to adjust the needle valve portion 140.

The secondary fuel delivery or discharge system for engine idling and low speed operation is illustrated in FIGS. 4, 8 and 13. The body component 11 is fashioned with a supplemental chamber or region 147, shown in FIG. 8, which is in communication with the mixing passage 17 by way of an engine idling orifice 149 and low speed orifices 150 and 151. The body portion or component 12 is fashioned with a bore 153, shown in FIG. 13, having a threaded portion which accommodates a threaded portion 154 of an adjustable valve member or restrictor 156, the valve member having a needle valve portion 157 extending into and cooperating with a restricted passage 158 which opens into a chamber or passage 159.

The passage 159 opens into an elongated perforation, open area, passage or channel 161 provided in the fuel flow control laminer member 14. The elongated perforation or passage 161, shown in FIGS. 4, 13, 15 and 16, opens into an enlarged region or open area 163 in the member 14, shown in FIGS. 8 and 13, establishing communication with the supplemental chamber 147. Fuel from the passage 159 flows through a portion of the elongated perforation, air bypass or air bleed passage 161 into the supplemental chamber 147 supplying air bled fuel to the engine idling and low speed discharge orifices or aperture means.

As shown in FIGS. 4, 8 and 15, the other end of the perforate region or passage 161 is in registration with a bore 165 which is in communication with a restricted aperture means or air bypass 166, the latter opening into the air inlet region 18 of the mixing passage 17. Thus, the air bypass or air bleed passage 166 admits filtered air from the air inlet region 18 of the mixing passage, the air flowing through the elongated passage 161, the air mixing with fuel delivered into the passage 161 from the passage 159, the fuel and air mixture flowing through the enlarged open area or region 163 into the chamber 147 adjacent the engine idling and low speed orifices.

The above-described arrangement of fuel delivered from the main orifice 126 for normal engine operation, and the flow of liquid fuel mixed with air from the bypass passage 161 to the supplemental chamber 147 for the secondary fuel delivery system is herein referred to as a dependent idle system. A dependent idle system is one in which the fuel for the secondary fuel delivery system is obtained from the region of the main fuel delivery system wherein the fuel for both systems is controlled or regulated by the position of the high speed control provided by the adjustable needle valve or restrictor 137.

Figure 28:
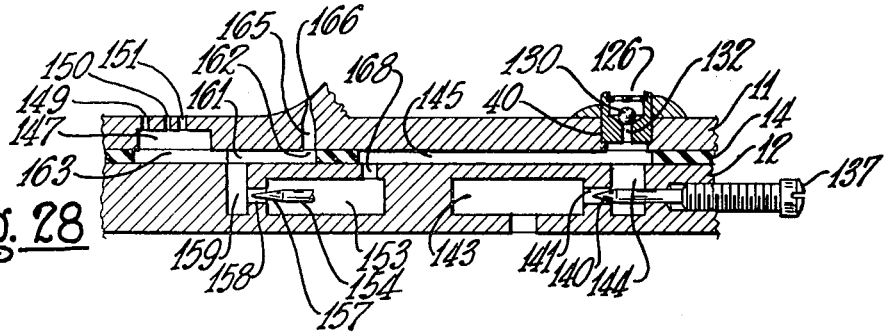
FIG. 28 is a semischematic sectional view illustrating air and fuel flow paths in passages in the body construction and in the fluid flow control means in the dependent idle system of the arrangement shown in FIGS. 7 and 8.

The fuel and air flow passages in the body 11, the supplemental body 12 and the fluid flow control means 14 are illustrated schematically in FIG. 28 for supplying fuel to the main orifice 126 and supplying fuel and air to the engine idling orifice 149 and low speed orifices 150 and 151 in the dependent idling system described.

Attention is directed to FIGS. 4, 13, 14 and 16 wherein the open area 145 in the fluid flow control member 14 establishes a fuel flow path from the cavity or chamber 143, passages 141, 144, 168 and the bore 153 accommodating the idle and low speed adjusting needle valve or restrictor 154, past the needle valve 157 and through passage 159 into the air bleed channel 161. All of the fuel for both the main or primary and secondary fuel delivery aperture means or systems flows from the fuel passage 143, receiving fuel from the fuel chamber or cavity 82, past the adjustable needle valve 140 of the restrictor 137.

The fuel for delivery or discharge from the main orifice or aperture means 126 flows from chamber 143 through the passage 144, through the passage 145, shown in FIGS. 7, 13 and 16, in the member 14, thence through the bore 132 in the fitting 40 past the check valve 130 and through the main orifice or aperture means 126 into the Venturi region of the mixing passage Fuel for the engine idling and low speed orifices or aperture means flows from the bore 143 past the needle valve portion 140 through the cavity 144 in the body 12 into the slot 145 in member 14 and through passage 168 into the bore 153, thence past the variable flow restrictor or adjustable needle valve 154 through passages 158 and 159 and channel 161 into the enlarged perforation or open area 163 at one end of the channel 161 and into the supplemental chamber or region 147 adjacent the engine idling and low speed orifices. Thus, the fuel for both the main orifice 126 and the engine idling and low speed orifices in a dependent idle system is regulated or controlled by the needle valve portion 140, and the needle valve portion 157 provides a supplemental adjustment for the fuel for engine idling and low speed purposes.

The air bleed passage or air bypass 166, shown in FIGS. 4, 8 and 15, is of a size to meter or control the amount of air flowing from the inlet region of the mixing passage through the channel 161 into the supplemental chamber 147 for mixing with the fuel delivered through the engine idling orifice 149 and low speed orifices or aperture means 150 and 151. The function of the check ball or valve means 130 in the main orifice fitting 40 is to prevent back bleeding of additional air through the main orifice 126 into the secondary fuel channel system when the engine idling orifice 149 or low speed orifices 150 and 151 are delivering fuel into the mixing passage. Otherwise, additional air would be bled through the main orifice 126 into the secondary fuel delivery system rendering the fuel and air mixture too lean and causing the engine to stall.

The fluid flow control member 14 includes a perforate pattern region providing open areas, passages or channels for conveying fuel and/or air to provide satisfactory operation of an internal combustion engine of different capacity or one having different operating characteristics. In the arrangement disclosed, other fluid flow control members of the same size as the member 14, shown in FIGS. 7, 8 and 16, may be interchanged one with another having a different perforate pattern region of open areas, channels or passages configurated to modify the fuel and air metering characteristics of the carburetor.

Several examples of fluid flow control laminate means for components are shown in the drawing and will be hereinafter described, each having a different perforate pattern of open areas, passages or channels for attaining certain methods of operation of the carburetor simply by interchanging one fluid flow control laminate or member for another. Additionally, the Venturi sleeve or member 24 may be interchanged with a Venturi sleeve having a different size of mixture flow passage rendering it possible to utilize the carburetor with engines of different sizes and capacities by interchanging one Venturi sleeve 24 for another.

The carburetor construction of the invention illustrated in FIGS. 1 through 8 includes two body components or members, namely a first body member 11 and a second body member 12, which may be die cast in volume production utilizing a single set of die casting dies for fashioning each component or member and modifying the characteristics and metering system by interchanging one fluid flow control member or laminate 14 for another of the same size provided with a different perforate pattern of open areas. Furthermore, by interchanging one Venturi sleeve or member 24 for another of different mixture flow capacity, the carburetor may be readily adapted for use with internal combustion engines of different sizes and horsepower ratings.

A die for stamping a fluid flow control member 14 from a strip of material is inexpensive as compared with the cost of die casting dies of different sizes for forming a carburetor body construction. Hence, the invention provides a carburetor construction adaptable for uses with various engines comprising a body construction of die cast body components 11 and 12 where heretofore it has been necessary to provide a different body casting die for each carburetor body for use with a particular size engine or for use with an engine having different operating characteristics. By utilizing standard carburetor body components or members of the invention, substantial savings are effected in providing carburetors for various uses.

As previously mentioned, the fluid flow control members or laminar means may be fashioned of various materials. Where the member 14 is of a resinous plastic or semihard material, the screws 88 may be drawn tightly compressing the resinous plastic or semihard material so that the single gasket 15 forms a fluid tight seal with the body components 11 and 12. FIG. 9 illustrates an arrangement similar to that shown in FIG. 8 wherein the fluid flow control member or laminate 14' is of metal, such as aluminum, brass or the like. Where a metal member 14' is used, it is desirable in addition to the gasket 15, to employ a gasket 172 contiguous with the other surface of member 14' to assure a fluid-tight seal with the body components or members 11 and 12.

The construction illustrated in FIGS. 1 through 8 includes a diaphragm fuel pump construction 69 in which a pumping diaphragm is pulse-operated by varying fluid pressure for supplying fuel under comparatively low pressure from a fuel supply to the inlet duct or passage 97 in the carburetor body component 11, shown in FIG. 7. The carburetor body component 11 is provided with an opening accommodating a nipple 176, shown in FIGS. 2, 3 and 6, which may be connected by a flexible tube (not shown) with a fuel supply tank (not shown) containing liquid fuel.

Disposed between the pump plate or pump body 70 and an upper surface of the carburetor body component 11 is a planar shaped member 178. Disposed between the member 178 and the carburetor body component 11 is a pumping diaphragm 180 of flexible impervious material which is resistant to deterioration by hydrocarbon fuel. The pump plate 70, the member 178 and the diaphragm 180 have registering openings to receive securing screws 71, threaded into openings in the body component 11 to secure these components in assembled relation.

Figure 6:
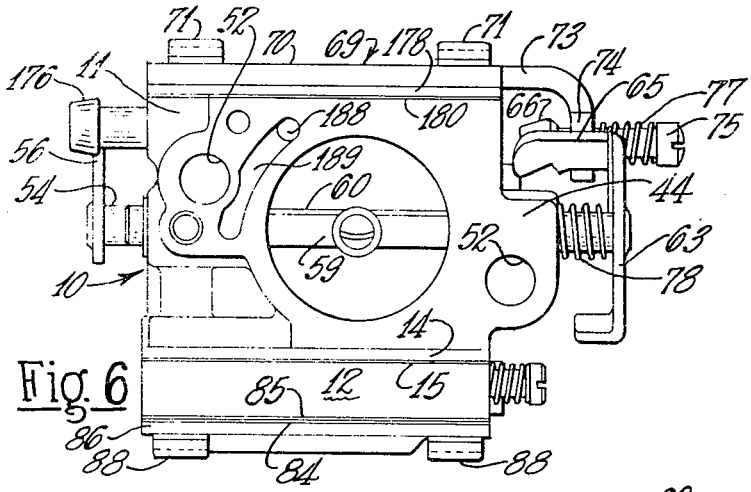
FIG. 6 is an elevational view of the mixture outlet end of the carburetor and fuel pump construction shown in FIG. 1.

The member 178 has an open area 182 providing a pulse or pumping chamber shown in FIGS. 7, 8, 10, 11 and 12. The interior surface of the plate 70 is provided with recesses or channels 184 in communication with channel 186, the channel 186 being in communication with an opening 187, shown in FIG. 3, provided in the carburetor body component 11. The channel 187 is in communication with a channel or passage 188 which opens into a channel, groove or recess 189 in the engine mounting face or surface 44 of the carburetor body component 11, as shown in FIG. 6.

The recess or groove 189 is adapted for registration with an opening (not shown) in the crankcase wall of a two cycle engine with which the carburetor is used. The diaphragm or pulsing energy is the varying pressures in the crankcase of the two cycle engine which case the flexible diaphragm 180 to vibrate at the region of the open space or chamber 182 in the member 178. Formed in the carburetor body component 11 adjacent the space or chamber 182 is a fuel chamber 192, one wall of the chamber 192 being the diaphragm 180.

The diaphragm 180 is formed with integral flap valves, the inlet flap valve 194 being shown in FIG. 11, and the outlet flap valve 195 shown in FIG. 12. As shown in FIG. 11, a chamber 197 is formed in the body 11, one wall of the chamber 197 being a portion 198 of the diaphragm 180. The pump plate or body 70 is fashioned with a vent opening 199, shown in FIG. 11. The chamber 197 adjacent the nipple 176 provides a surge chamber to cushion the impact of incoming fuel caused by the closing of the inlet flap valve 194 abruptly by a pulse or flexing movement of the diaphragm 180 toward the fuel chamber 192. Movement of the inlet flap valve 194 is accommodated in space 200, shown in FIG. 11.

During a reduced pressure or suction pulse in the air or pumping chamber 182, the portion of the diaphragm adjacent the fuel chamber 192 is moved or flexed away from the fuel chamber causing the inlet flap valve 194 to open, admitting fuel from the supply through the nipple 176 and connecting channels 202 and 203 past the inlet valve 194 through the space or open area 200 of member 178 thence through connecting chambers 205 and 206, shown in FIG. 10, into the fuel chamber 192. A pressure impulse or pressure wave from the engine crankcase, communicated to the pumping chamber 182 through the pulse passage 188, passage 186 and recess 184 shown in FIGS. 3 and 10, forces the diaphragm toward the fuel chamber 192.

This movement of the pumping diaphragm 180 causes the inlet flap valve 194 to close and the outlet flap valve 195 to open. This action forces fuel in chamber 192 to flow through interconnecting passages 208 and 209, shown in FIG. 12, past the outlet flap valve 195 into the chamber 211, shown in FIGS. 7 and 12.

The fuel in the space 211 flows through the screen or filter 98 and through passage 97 into the chamber 95 in the carburetor body 11. The chamber 95, while containing fuel, provides a surge chamber to cushion the impact of moving fuel upon closing of the outlet flap valve 195 of the pump.

During engine operation the region of the pumping diaphragm 180, adjacent the fuel chamber 192 and the pulse chamber 182, is rapidly flexed or vibrated and the flap valves 194 and 195 rapidly actuated to cause fuel flow from the supply through the fuel chamber or region 192 into the surge chamber 95 in the carburetor body component 11 so that fuel, under a comparatively low pressure of about 5 pounds per square inch is maintained in the chamber or region 95 at the fuel inlet port 106, shown in FIG. 7.

The surge chambers 197, shown in FIG. 11, and 95, shown in FIG. 7, function to enable or foster a more smooth flow of fuel through the chamber 192 and, at high frequency vibrations of the pumping diaphragm 180, effects a substantial increase in delivery of liquid fuel through the pump to the carburetor to satisfy the fuel requirements of high speed engine operation.

The operation of the charge forming apparatus illustrated in FIGS. 1 through 8, 13 and 14 is as follows: In starting an engine equipped with the carburetor of the invention, the operator opens the throttle valve 60 and closes the choke valve 56. The reciprocation of the engine piston sets up reduced pressure or aspiration in the mixing passage 17. The aspiration or reduced pressure is effective to cause fuel to flow from the fuel chamber 82 in the body component 12 through the channel 143 past the needle valve 140, shown in FIG. 14, through the channel 144 and the opening 145 in the fluid flow control member 14, thence through the passage or bore 132 in the fitting 40 and into the mixing passage through the main orifice 126.

When the engine is started, the choke valve 56 is opened manually by the operator, the speed of the engine then depending upon the extend of opening of the throttle valve 60. The ratio of fuel to the air flow through the mixing passage 17 and Venturi 26 is controlled by adjusting the high speed needle valve 140.

When the throttle 60 is moved near closed or engine idling position viz. the position shown in FIG. 8, the fuel flow for engine idling is as follows: Engine aspiration is effective through the engine idling orifice 149 to deliver fuel into the mixing passage downstream of the throttle valve 60 from the supplemental fuel chamber 147. The fuel for engine idling purposes is primarily metered by the position of the high speed adjusting valve 140, and fuel for engine idling flows from the passage 144 through the open area or channel 145 in the control member 14 to the passage 168, shown in FIG. 13, and past the engine idling adjusting valve 157 through the passage 159 thence through the open area or elongated channel 161 and through the enlarged open area 163, shown in FIGS. 4, 8 and 16, into the supplemental chamber 147 and is delivered through the idling orifice 149 to the engine.

The other end of the elongated channel 161 is in communication with the restricted air bleed passage 166 which provides for a limited or metered amount of air for mixing with the fuel in the chamber 147 prior to its delivery through the engine idling orifice 149. The air bleed restriction 166 opens into the mixing passage, as shown in FIG. 15, so that filtered air, which flows through a filter (not shown) into the mixing passage, is admitted to the channel 161.

During delivery or discharge of fuel through the engine idling orifice 149, the check or ball valve 130 is engaged with the seat in the main orifice fitting 40, as shown in FIGS. 7 and 8, to prevent back bleeding of additional air to the engine idling and low speed fuel delivery system. Too much air admitted to the system would cause the engine to stall.

As the throttle valve 60 is partially opened by the operator, additional fuel and air mixture from chamber 147 flows into the mixing passage through one or both low speed orifices or apertures 150 and 151 depending upon the extent of opening of the throttle valve 60. As the engine speed increases upon further opening of the throttle valve 60, the delivery of fuel and air mixture through the engine idling and low speed orifices 149, 150 and 151 progressively decreases as fuel is delivered from the main orifice 126 for normal and high speed operation.

The die cast body component 11 is of a character to accommodate an overspeed governor construction when desired wherein a vibration-responsive body is actuated by a frequency of vibration of the engine occurring at a particular speed, the vibration displacing or oscillating the valve body away from engagement with a valve seat permitting additional fuel to be delivered into the mixing passage.

Such excess amount of fuel in the mixture provides an overrich fuel and air mixture which is extremely slow burning or may be nonignitable so that the engine speed is reduced and the engine thereby prevented from exceeding a critical speed. To equip the carburetor body 11 with an overspeed governor device simply requires the drilling of two passages and threading a cored cylindrical recess in the body component or member 11 whereby the same body member 11, shown in FIG. 7, may be utilized.

Figure 17:
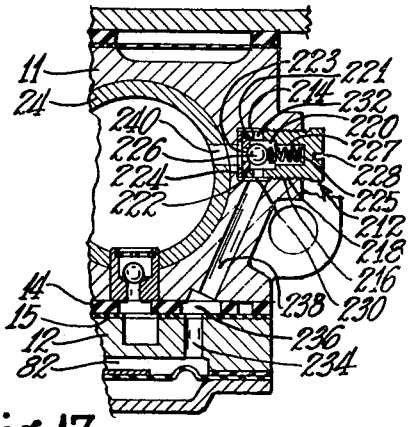
FIG. 17 is a fragmentary sectional view of the construction shown in FIG. 7 embodying an engine overspeed governor arrangement.

Referring to FIG. 17 illustrating an overspeed governor device 212 in assembly in the body component 11, the wall of the cylindrical cored recess 214, shown in FIG. 7, which is die cast in the body component 11, is threaded as at 216, shown in FIG. 17, to accommodate a fitting or valve cage 218. The valve cage 218 is provided with a first counterbore 220 and a second counterbore 221. Disposed in the counterbore 221 is a disc-like annular valve seat 222 fashioned with a port or passage 223, a gasket 224 being disposed between the valve seat member 222 and the bottom of the cylindrical recess 214.

Disposed in the counterbore or chamber 220 is a vibration-responsive body in the form of a ball valve 226 which is resiliently biased to a position normally closing the port 223 under the influence of comparatively light pressure of an expansive coil spring 225 disposed in a bore 227 in the fitting 218. A kerf 228 is formed in the exterior portion of the fitting 218 to accommodate a suitable tool for threading the fitting 218 into or out of the threaded wall 216 of the recess 214.

The ball valve 226 is of lesser diameter than the diameter of the counterbore 220 to effect lateral or sidewise movement of the ball valve 226 away from the port-closing position. The fitting 218, at the region of the counterbore 220, is fashioned with a peripheral recess 230. The fitting 218 is provided with a plurality of circumferentially spaced openings or passages 232 which register with the peripheral recess 230.

As shown in FIGS. 7 and 17, the body component 12 is provided with a passage or channel 234 which opens into an open area or channel 236, shown in FIGS. 7, 16 and 17, in the fluid flow control member 14. As shown in FIG. 7, the open area 236 in the control member 14 is normally blocked by a lower wall of the carburetor body component 11. In order to establish fuel flow to the overspeed governor device, a passage or channel 238 is drilled in the body component 11 establishing communication between the open area 236 in the control member 14 and the peripheral recess 230 provided in the fitting 218.

A passage or channel 240, shown in FIG. 17, is drilled through a portion of the body component 11 adjacent the bottom of the recess 214 and through the Venturi sleeve or member 24, the passage 240 registering with the port 223 in the valve seat 222. The mass of the ball valve 226 and the degree of resilience or pressure of the biasing spring 225 are selected or calibrated whereby the ball valve will be displaced laterally from its seat 222 by the frequency of engine vibrations or disturbances occurring at or near the maximum speed desired for the engine.

In operation, when the engine vibrations reach a frequency at which the ball valve 226 is responsive, the ball valve is displace, usually sidewise or laterally in the chamber provided by the counterbore 220 and away from its position blocking the port or passage 223, whereupon fuel from the fuel chamber 82 is aspirated through channel 234, the open area or channel 236 in the fluid conveying or fluid flow control member 14, through the drilled passage 238, recess 230 and passages 232 in the fitting 218 thence through the chamber provided by the counterbore 220 and through the port 223 and passage 240 into the mixing passage.

This excess or additional fuel delivered into the mixing passage provides an overrich fuel and air mixture delivered into the engine crankcase thence to the engine cylinder or cylinders. The overrich fuel and air mixture is slow burning or may be nonignitable and causes engine speed to be automatically and substantially instantly reduced thereby preventing overspeeding of the engine.

Through the provision of the standard carburetor body members or components 11 and 12 and the open area 236 in the fluid conveying or fluid flow control member or laminate 14, fuel is readily available for engine governing purposes simply by threading the wall of the cored recess 214 to accommodate the engine governing device 212, drilling the passage 238 in the body 11, and drilling the passage 240 through the portion of the body at the bottom of the cored recess 214 and through the Venturi sleeve or member 24. Through this method, the standard carburetor body component 11 may be readily adapted to accommodate the engine governing device 212 without necessitating the fabrication of a different body casting.

The restricted air bleed passage 166, shown in FIG. 15, is in registration with an end region 162 of the elongated slot or channel 161 through which a limited or metered amount of air from the mixing passage flows through the restricted air bleed passage 166 and throughout the length of the elongated slot, open area or channel 161 in the fluid flow control member or laminate 14 to the open area 163, shown in FIGS. 8 and 16, providing some air for mixing the fuel providing an emulsion for engine idling and low speed purposes.

The present invention enables the length of travel of the air for mixing with the fuel in chamber 147 to be altered by simply modifying the length or contour of the open area or channel 161 by utilizing interchangeable fluid flow control laminar members or laminates having modified perforate pattern regions, passages or open area configurations. It may be desirable, in order to readily modify the flow characteristics of the air bleed channel or air bypass system for mixing air with fuel in the supplemental chamber 147, to provide several air bleed or air bypass passages in the carburetor body 11 opening into the mixing passage 17, each of such air bleed passages being selectively available for registration with an open area or channel configuration in a particular flow control member or laminate.

Thus, by simply interchanging one fluid flow control laminar member 14 for another, several different air flow paths for air bleed purposes are available simply by changing the lengths or contours of the air flow channels in various interchangeable fluid flow control laminar members.

Figure 18:
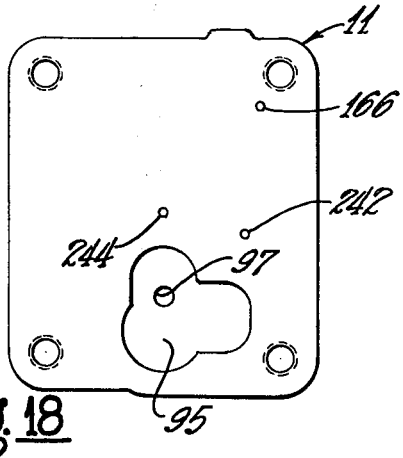
FIG. 18 is a view similar to FIG. 4 with a supplemental body component and a fluid flow control component removed illustrating several optional positions of air bleed for the engine idling and low speed fuel delivery system.

Referring to FIG. 18, there is illustrated a bottom plan view of the body component 11 with the fluid flow control member 14 and body component 12 removed, the view illustrating two additional air bleed or air bypass passages or aperture means 242 and 244 that may be drilled in the body 11 and open into the mixing passage 17. In event a modified path for air bleed purposes is desired, the passage 244 into the mixing passage may be utilized. To accomplish this purpose a fluid conveying or fluid flow control member 14*a*, shown in FIG. 19, is provided which is interchangeable with fluid flow control member 14.

Figure 19:
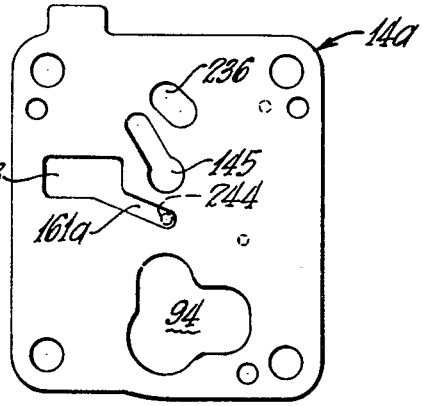
FIG. 19 is a plan view of a control component of the same size as that shown in FIG. 16 having a modified arrangement of open areas or passages accommodating fluid flow.

It should be noted that the air flow channel 161*a* in the member 14*a* is comparatively short, having its end in registration with the air bleed passage 244 in the carburetor body 11, the relative position of the air bleed passage 244 being indicated in broken lines in FIG. 19. Air flows from the mixing passage through the restricted passage 244 and the short channel or open area 161*a* into the enlarged open area 163, the air being mixed with the fuel in the supplemental chamber 147, shown in FIG. 8. The air for air bleed purposes may be metered by the size of the restricted air bleed passage 244 or by modifying the width or cross sectional area of the comparatively short channel or open area 161*a*.

Figure 20:
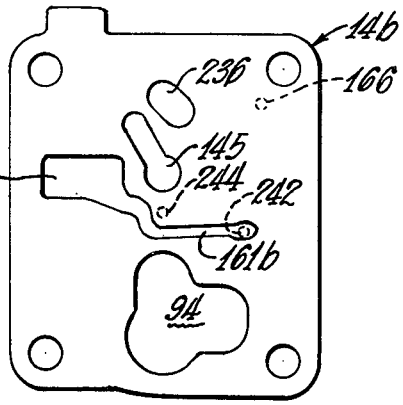
FIG. 20 is a plan view of a control component of the same size as that shown in FIG. 16 having a modified arrangement of open areas or passages accommodating fluid flow.

FIG. 20 illustrates the configuration of a slot or open area 161*b* in a fluid conveying or fluid flow control member 14*b* where it is desired to obtain air for air bleed purposes through the restricted passage 242 opening into the air inlet region of the mixing passage 17. As shown in FIG. 20, the end region of the channel or open area 161*b* is in registration with the air bleed passage 242, the elongated passage or open area 161*b* being contoured so as to be out of registration with the air bleed passages 165 and 244.

Thus, the air bleed passages 166 and 244 are blocked or closed by solid portions of the fluid flow control member 14*b*, but air flow is established from the mixing passage through the restricted passage 242, channel or open area 161*b* to enlarged open area region 163 providing air for mixing the fuel in the supplemental chamber 147.

In installations where the air bleed passage 244 is utilized with the control component or member 14*a*, shown in FIG. 19, a substantial difference in operation of the carburetor occurs at certain engine speeds. With the throttle in near closed or engine idling position and air bleeding provided through the air bleed passage 224, shown in FIGS. 18 and 19, engine idling operation will be similar to engine idling operation when one or the other air bleed passages 166 or 242, shown in FIG. 20, is utilized.

However, where the air for mixing with the engine idling fuel is obtained through the passage 244, the partial opening of the throttle valve 60 causes a substantial increase in air velocity in the mixing passage and hence substantial reduced pressure or suction in the Venturi. Upon the increase in suction on the main orifice with the partially opened throttle, the amount of air entering the restricted passage 224 is greatly reduced.

Thus, by changing the relative position of the restricted air bleed passage opening into the mixing passage, such as the positions indicated at 166, 242 and 244 or other desired position, the metering characteristics of the carburetor may be varied to provide for successful operation with an internal combustion engine having particular operating characteristics.

Figure 21:
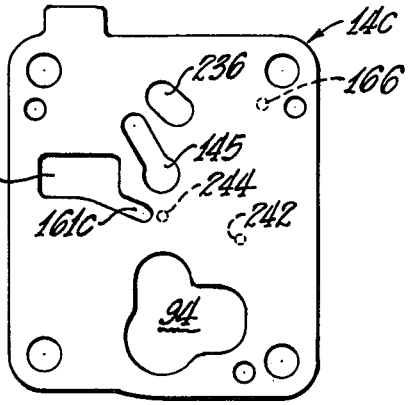
FIG. 21 is a plan view of a control component of the same size as that shown in FIG. 16 having a modified arrangement of open areas or passages accommodating fluid flow.

FIG. 21 illustrates a fluid conveying or fluid flow control component or member **14*c* contoured whereby there is no admission of air through any of the air bleed passages 166, 242 and 244. The channel or open area 161*c* is comparatively short and its end region is in registration with the fuel flow passage 159, shown in FIG. 13. The fuel for engine idling and low speed purposes flows from the passage 159 into the channel 161*c* and into the enlargement 163 and the supplemental chamber 147. It will be apparent that where no air bleeding is desired for the fuel for engine idling and low speed purposes, the fluid flow control member 14*c* is substituted for the control member 14**.

Figure 22:
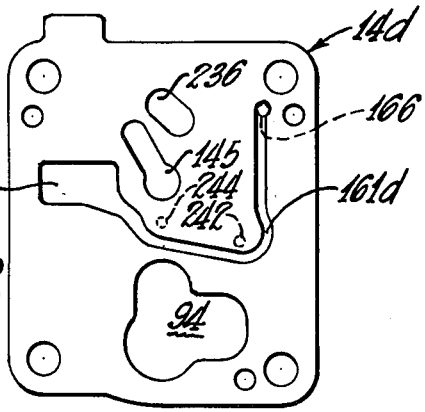
FIG. 22 is a plan view of a control component of the same size as that shown in FIG. 16 having another modified arrangement of open areas or passages accommodating fluid flow.

FIG. 22 illustrates a fluid conveying or fluid flow control member or laminate **14*d* having an air bleed channel 161*d* configurated to register with the air bleed passage 165, opening into the mixing passage for conveying air to the enlarged open area 163 in communication with the supplemental fuel chamber 147. Where a long air bleed channel is desired for conveying air for admixing with the fuel in the supplemental chamber 147 for metering purposes, the channel 161*d* conveys air from the air bleed passage 166 into the enlarged region 163, the optional air bleed passages 242 and 244 being obstructed or closed by a solid region of the control member 14*d* as illustrated in FIG. 22**.

Figure 23:
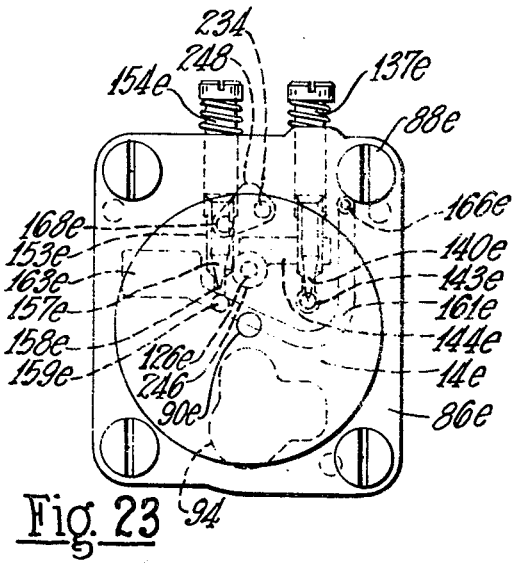
FIG. 23 is a bottom plan view similar to FIG. 4 of the carburetor and fuel pump construction illustrating a fluid flow control member having a modified arrangement of open areas accommodating fluid flow.

FIG. 23 is a view similar to FIG. 4 illustrating the carburetor embodying a fluid flow control laminate, plate or member **14*e*** having a perforate pattern region of open areas, slots or passages establishing fluid flow to provide a metering system of the so-called independent idle type. An independent idle system is defined as metering or calibration arrangement wherein the fuel for delivery through the engine idling and low speed orifices into the mixing passage is taken directly from the fuel chamber in the carburetor independently of the fuel taken from the fuel chamber and delivered through the main fuel orifice or aperture means into the mixing passage.

Figure 29:
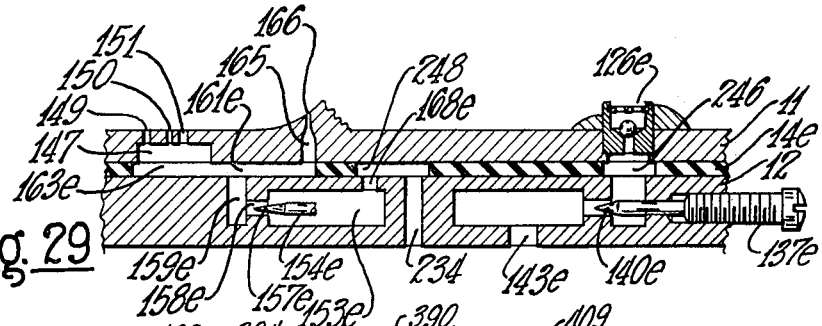
FIG. 29 is a semischematic sectional view illustrating air and fuel flow paths in passages in the body construction and in the fluid flow control means in the independent idle system of the arrangement shown in FIG. 23.

FIG. 29 illustrates schematically the fuel and air flow passages in the body components and the laminar means for supplying fuel to the main orifice and supplying fuel and air to the engine idling and low speed orifices in the independent system to be described.

Figure 24:
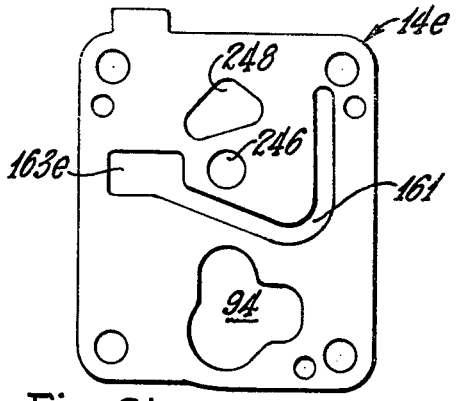
FIG. 24 is a plan view of the fluid flow control component embodied in FIG. 23.

One form of fluid conveying or fluid flow control component, laminate or member **14*e* for accomplishing this purpose is illustrated in FIG. 24. Referring to FIG. 23, the bottom cover plate 86*e* is secured to the carburetor body 11 by screws 88*e*, the screws 88*e* also holding the body member 12 and the control member 14*e* in assembled relation. The space between the diaphragm and the cover 86*e* is vented by an opening 90*e*. The carburetor construction of FIG. 23 includes a high speed adjustable valve member or restrictor 137*e* and an idle and low speed adjustable valve member or restrictor 154*e***.

The fuel for high speed engine operation flows from a fuel chamber 82, shown in FIGS. 7 and 8, through the passage **143*e* past the needle portion 140*e* of the valve member 137*e*, thence into a passage 144*e* in the body 12. The fuel flows from the passage 144*e* through a perforation, open area or passage 246 in the fluid flow control component or member 14*e* and through passages in a fitting 40, shown in FIGS. 7 and 8, the fuel being discharged into the choke band region of the Venturi of the mixing passage through a main orifice or aperture means 126*e***.

The engine idling or low speed fuel delivery or discharge system illustrated in FIG. 23 is inclusive of the adjustable valve or restrictor **154*e* having a needle valve portion 157*e* which regulates fuel flow through a restricted passage 158*e* for delivery through a passage 159*e* in the body component 12 into an air bleed channel 161*e* in the flow control component 14*e* thence through the enlargement 163*e* into the supplemental chamber 147 shown in FIG. 8, the fuel being delivered into the mixing passage through the engine idling orifice 149 when the throttle 60 is in engine idling position, and through low speed orifices or aperture means 150 and 151** when the throttle is in partially opened or low speed position.

The fuel for the engine idling and low speed system is obtained from the fuel chamber, such as the fuel chamber or cavity 82, shown in FIGS. 7 and 8, independently of the fuel passage **143*e* through which fuel is obtained for delivery through the main orifice 126*e*. As shown in FIGS. 23 and 24, the fluid flow control component or member 14*e* is fashioned with a triangularly-shaped open area, passage or channel 248 which is in registry with the fuel supply passage 234, shown in broken lines in FIG. 23, fuel from the fuel chamber 82 flowing through the passage 234 into the open area 248**.

The open area 248 is in registration with an opening **168*e* which corresponds with the opening 168, shown in FIG. 13. Fuel in the passage 168*e* flows through the bore 153*e* past the needle valve or restrictor 157*e* and through the passages 159*e* into the air bleed channel 161*e* and into the enlargement 163*e* for delivery through the engine idling and low speed orifices. It should be noted from FIG. 23 that the fuel for the high speed orifice or aperture means is obtained directly from the fuel chamber through the passage 143*e*, while the fuel for the secondary fuel delivery or engine idling and low speed system flows directly from the fuel chamber 82 through the passage 234 which is wholly independent of the fuel passage 143*e*. The above-described arrangement is shown schematically in FIG. 29**.

The other terminus of the air bleed passage **161*e* is in registration with an air bleed passage, air bypass or aperture means 166*e* opening into the mixing passage in the manner of the passage 166 shown in FIG. 15. Thus, in the arrangement shown in FIGS. 23 and 24, the air bleed passage 161*e*, for supplying air for mixing with the fuel at the region of the passage 159***e*, is of the character illustrated at 161 in FIG. 4 providing a channel of substantial length for conveying air for mixing with the fuel at the region of the passage 159*e*.

It is to be understood that the fluid conveying or fluid flow control components illustrated in FIGS. 19, 20, 21 and 22 are interchangeable with the fluid flow control component 14*e* and any of the components illustrated in these figures may be substituted for the component 14*e* in the arrangement shown in FIG. 23 to provide air bleed channels of different lengths to modify or control air bleeding or bypassing of air into the fuel at the region of the fuel passage 159*e*.

Figure 25:
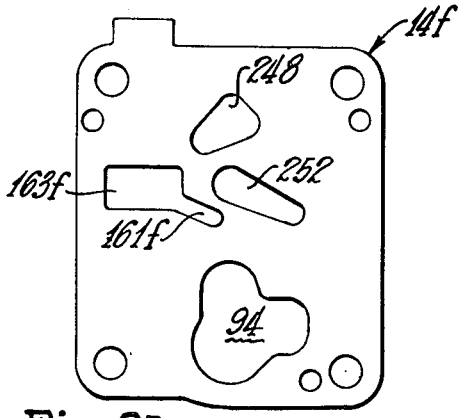
FIG. 25 is a plan view of a control component of the same size as that shown in FIG. 16 having a modified arrangement of open areas accommodating fluid flow.

FIG. 25 is a plan view of a fluid conveying or fluid flow control laminar means, plate or member 14*f* which is interchangeable with any of the other fluid flow control laminar members described herein. The laminar member 14*f* is fashioned with perforate regions or passages adapting the carburetor to a metering system wherein a fixed main orifice, without an associated adjusting needle valve, is employed for delivering fuel into the mixing passage for normal and high speed engine operation, and wherein fuel for engine idling and low speed purposes is derived through passage means from the fuel chamber 82 independently of the fuel from the chamber for direct discharge through the fixed main orifice or aperture means.

In an arrangement of this character employing a fixed main fuel delivery aperture, orifice or jet, the high speed adjusting valve 137, shown at FIG. 14, or the high speed adjusting valve 137*e*, shown in FIG. 23, may be eliminated. In employing a fixed jet or main fuel delivery orifice without an adjustable valve means, the same die cast body 12 is utilized but the cored recess for accommodating the valve means 137 and 137*e* would not be drilled or threaded.

In the use of the arrangement having perforate regions or passages illustrated in the control component 14*f*, the fuel for delivery through the fixed main orifice or fixed jet is obtained from the fuel chamber 82 in the carburetor through the passasge 143, shown in FIG. 14, or passage 143*e*, shown in FIG. 23. This passage is in registration with an end region of a perforate region or slot 252, shown in FIG. 25, the other end region of the slot 252 being in registration with the passage means in the fitting 40, shown in FIGS. 7 and 8, whereby the fuel is discharged directly through the main orifice 126, or through the main orifice 126*e*, shown in FIG. 23.

The fluid flow control laminate 14*f* is provided with a triangular open region or passage 248 which, in association with the fuel flow passages shown in FIG. 13, conveys fuel to an air bleed passage or air bypass channel 161*f*, the flow path of the fuel for engine idling and low speed purposes being the same as described in connection with FIG. 23. The fuel mixed with air from the air bleed channel 161*f*, which corresponds with the air bleed channel 161*c* in FIG. 21, flows into the enlargement or perforate region 163*f* and the supplemental chamber shown at 147 in FIG. 8.

Figure 26:
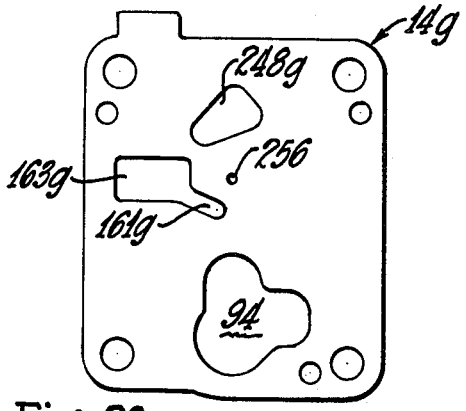
FIG. 26 is a plan view of a further form of control component of the same size as that shown in FIG. 16 having a modified arrangement of open areas accommodating fluid flow.

FIG. 26 illustrates a fluid conveying or fluid flow control laminate 14*g* usable with the carburetor embodying an independent idling system and providing a metering opening in the control laminate for fuel delivered through the main orifice, such as the main orifice 126, shown in FIGS. 7 and 8. In this form, the laminate 14*g* is fashioned with a fuel metering opening or passage 256 which is in alignment with the passage 132 in the main orifice fitting 40, shown in FIG. 8.

The fuel supply for the metering opening 256 in the laminate 14*g* is obtained directly from the fuel chamber by drilling an opening (not shown) in the thin metal portion or web 146 separating the passage 144, shown in FIGS. 7 and 8, from the fuel chamber 82. The fixed metering orifice 256 in the component or member 14*g* in direct communication with the fuel chamber 82, eliminates the use of the high speed adjusting valve 137, shown in FIG. 14, or valve 137*e*, shown in FIG. 23, and the passage 143, shown in FIG. 4.

The component or laminate 14*g*, shown in FIG. 26, embodies a triangularly-shaped perforate region 248*g* to facilitate delivery of fuel from the carburetor fuel chamber 82 to the engine idling and low speed fuel delivery system independently of the fuel delivery system for the main orifice. The fuel for engine idling and low speed purposes flows from passage 248*g* through the bore accommodating the engine idling adjusting valve 154 into an air bleed channel 161*g*. The fuel mixed with air is flowed through the enlargement or perforate region 163*g* into the supplemental chamber 147, shown in FIG. 8, for delivery to the engine idling and low speed orifices or aperture means.

It will be apparent that fuel sources, air channels or differential air pressures and mixture pressures are available at selected open areas in the fluid flow control component or metering member, thus providing flexibility in metering which is generally accomplished simply by interchanging one fluid flow control component for another having a different pattern of open areas, channel or passages. Furthermore, if an increase or decrease in air flow capacity of the mixing passage 17 is desired, a Venturi sleeve or member 24 of different interior dimension or configuration may be inserted in the passage in the body 11. Through this expedient one size of carburetor body 11 may be adapted to engines of different volumetric capacities, sizes or engines having different operating characteristics.

Figure 27:
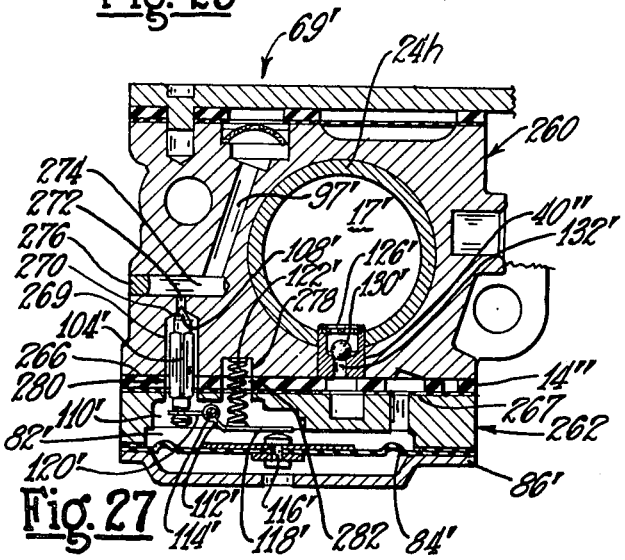
FIG. 27 is a transverse sectional view similar to FIG. 7 illustrating a modified form of carburetor body component construction.

FIG. 27 is a sectional view similar to FIG. 7 illustrating a modified arrangement of the carburetor body components wherein the fuel inlet control valve is slidably disposed in a bore provided in the body component fashioned with the mixing passage. In the arrangement shown in FIG. 27, the carburetor construction comprises a first body 260 and a second body 262 both being formed as die castings. Disposed between the bodies 260 and 262 is a fluid conveying or fluid flow control component, plate or member 14'' which may be the same size as the fuel flow control components hereinbefore described.

The carburetor may be equipped with a removable venturi member 24h. In the form of the invention shown in FIG. 27, the lower surface 266 of the body 260 is a planar surface, the member or laminar means 14'' being in contiguous engagement with the surface. A sealing gasket 267 is preferably disposed between the laminar means 14'' and the second body 262. A fitting 40'' is disposed in a bore in the body 260 and extends into the mixing passage 17', the outlet 126' of the fitting being the main orifice for delivering fuel into the mixing passage. A ball check valve 130' normally prevents back bleeding of air through the fuel passage 132' when fuel is being delivered through the engine idling orifice 149, shown in FIG. 8.

The body 262 is fashioned with a fuel chamber 82', one wall of the chamber being a flexible diaphragm 84'. A cover member 86' is disposed beneath the diaphragm 84'. A lever 112' disposed in a recess region 110′ of the fuel chamber 82′ is fulcrumed on a pin 114′. The long arm 118′ of the lever is adapted to be engaged by a headed member 116′ carried by the diaphragm 84′. The short arm 120′ of the lever is articulately connected with the lower end of a valve body 104′.

In this form of carburetor construction, the carburetor body component 260 is fashioned with a bore 269 accommodating the valve body 104′ for slidable movement in the bore 269. The upper end of the bore 269 is fashioned of frusto-conical shaped surface 270, a valve port or passage 272 being provided at the apex region of the frusto-conically shaped surface 270, the passage 272 being in communication with a bore or passage 274 which is in communication with the fuel passage 97′. The outer end of the bore or passage 274 is closed by a plug 276.

The valve body 104′ is fashioned with a cone or needle-shaped valve or valve portion 108′ which normally closes the port 272 as it seats on the ledge provided by the frusto-conically shaped surface 270. The fuel passage 97′ receives fuel from the diaphragm fuel pump construction 69′ of the character hereinbefore described. The lever 112′ is normally biased in a direction urging the fuel inlet valve 108′ to port-closing position by an expansive coil spring 122′ engaging the long arm of the lever. The upper region of the spring 122′ is nested in a recess or bore 278 provided in the carburetor body component 260.

The fluid flow control means or laminate 14″ is provided with a perforate pattern of open areas for controlling and conveying fluids, such as liquid fuel and air, to various channels for delivering fuel through the main orifice 126′ into the mixing passage as well as controlling air bleeding into fuel for engine idling and low speed purposes before its delivery into the mixing passage. The fluid flow control means or laminate 14″ is of the same size as the components 14 through 14*g*, the component 14″ differing from the other components in that it has a circular opening 280 registering with the bore 269 to accommodate the fuel inlet valve body 104′, and a second circular opening 282 registering with the bore 278 accommodating the coil spring 122′.

Any of the fluid flow control components 14 through 14*g* may be configurated with the circular openings 280 and 282 for installation in the carburetor construction, shown in FIG. 27, as each of these control components provided with the openings 280 and 282 would be interchangeable in the assembly shown in FIG. 27. In such a control component, the opening 94 shown in the control components of FIGS. 16 and 19 through 26 would be eliminated.

In the arrangement shown in FIG. 27, the fuel passages 97′ and 274 from the fuel pump construction to the region of the fuel inlet valve 108′ provide a surge chamber means to absorb and dissipate energy of momentum of the fuel flowing past the outlet flap valve of the pump construction 69′.

The use of a first body component and a second body component and a fluid flow control component, member or plate associated with the body components enables the fabrication of a carburetor construction in which the metering or control of fluid flow is accomplished simply by interchanging one fluid flow control component or plate for another as hereinbefore explained. The invention enables high volume production of two die cast body components of a carburetor which are usable through the interchangeability of the fluid conveying or fluid flow control components to adapt the carburetor for use with various engines of different sizes and capacities or requiring different metering characteristics and without necessitating the making of different die cast bodies.

Each of the fluid flow control components is readily made from sheet material through the use of a punching die of the desired configuration, and such punching dies are inexpensive. The fluid flow capacity of the open areas in the several examples of fluid flow control components may be varied by using material of a different thickness or of making the passages wider or narrower as required for particular metering or operating characteristics for the carburetor.

In event that an engine governor construction is to be embodied in the carburetor as shown in FIG. 17 the cored recess 214, shown in FIG. 7, in the standard body component 11 is drilled and threaded to accommodate the overspeed governor construction 212 and the passage 238 drilled in the standard body component so that no new die cast body is required.

If a fixed main orifice, aperture or jet construction is desired, the drilling of the bore 134, passage 141 and the threading of a portion of the bore, shown in FIG. 14, is eliminated so that no new or different body casting 12 is required for this modification of carburetor operation.

As hereinbefore described, the carburetor body components 11 and 12 require no modification to convert a dependent idle system to an independent idle system, as this may be accomplished through the use of a selected pattern of open areas in a fluid flow control component or plate such as shown at 14*e* in FIGS. 23 and 24. The invention provides a high degre of flexibility in adapting the carburetor construction to various operating conditions and metering characteristics such as by modifying fuel flow, and for air bleed purposes modifying air flow, through the expedient of utilizing a selected fluid flow control laminate having a perforate pattern or orientation of open areas or passage to attain the metering or operating characteristics desired for the carburetor and utilizing the same die cast carburetor body components for the many adaptions.

FIGS. 30 through 38 illustrate a modified form of charge forming apparatus embodying the invention. In the system or arrangement of fluid flow control shown in these figures, a regulated fuel supply to the fluid flow control construction or arrangement is provided by a float-controlled means. In this form, the charge forming apparatus or carburetor construction 295 includes a body, body member or component 298 which is a die casting of metal or may be cast or molded of other suitable material.

The body 298 is fashioned with an air and fuel mixing passage 300 which is inclusive of an air inlet region or air induction zone 302, a fuel dispersion zone which includes main and supplementary fuel delivery aperture means or orifices, a Venturi configuration 304 and a mixture outlet region 306. In the embodiment illustrated, a tubular fitting or member 307 is secured to the mixture outlet end of the body 298 by means of screws 309 extending through openings in a flange portion 310 of the fitting, the screws extending into threaded openings in the body 298, a sealing gasket 308 being disposed between the flange portion 310 and the body 298.

The lower end of the fitting 307 is fashioned with a flange 311 for connection with a manifold or means (not shown) for conveying fuel and air mixture from the outlet region 306 to an internal combustion engine. The flange 311 is fashioned with openings 312 to accommodate screws (not shown) for securing the fitting 307 to a manifold. If desired, a mixture conveying means or manifold may be secured directly to the body 298.

The upper end of the body 298 may be fashioned with a flange 314 for mounting an air filter (not shown) for filtering air entering the mixing passage 300. Journaled in bores in the body 298 and extending across a cylindrical region 306 of the mixing passage 300 is a shaft 316, the shaft supporting a disc-like throttle valve 317 of conventional construction.

Figure 34:
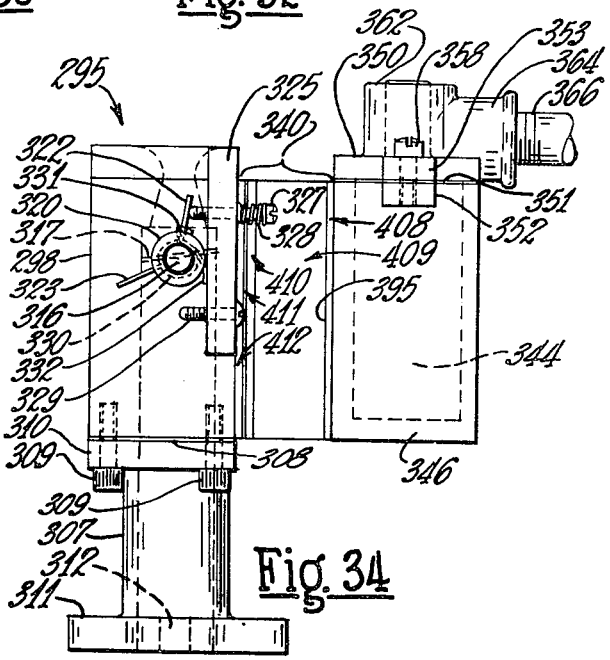
FIG. 34 is a view of the opposite side of the construction shown in FIG. 30.

An arm 319 is connected with the shaft 316 for actuation of the throttle valve 317 by an operator. Secured to the shaft 316 is a member or collar 320 equipped with projections or pins 322 and 323. The body 298 is fashioned with a projecting portion or flange 325 having two threaded openings, one receiving an adjustable abutment screw 327, the other receiving or accommodating an abutment screw 329 as shown in FIG. 34. Surrounding the abutment screw 327 and disposed between the head of the screw and the flange 325 is a coil spring 328 for frictionally retaining the screw 327 in adjusted position.

The throttle valve 317 is urged or biased toward near closed or engine idling position by a coil spring 330 having one end 331 engaged with the pin 322, the other end 332 engaging a surface of the flange 325. The adjustable stop or abutment screw 327 is engaged by the pin 322 and determines the adjustment of the throttle valve 317 in engine idling position. The screw 329 is engaged by the pin 323 when the throttle valve 317 is in full open position.

Figures 36, 37, 38:
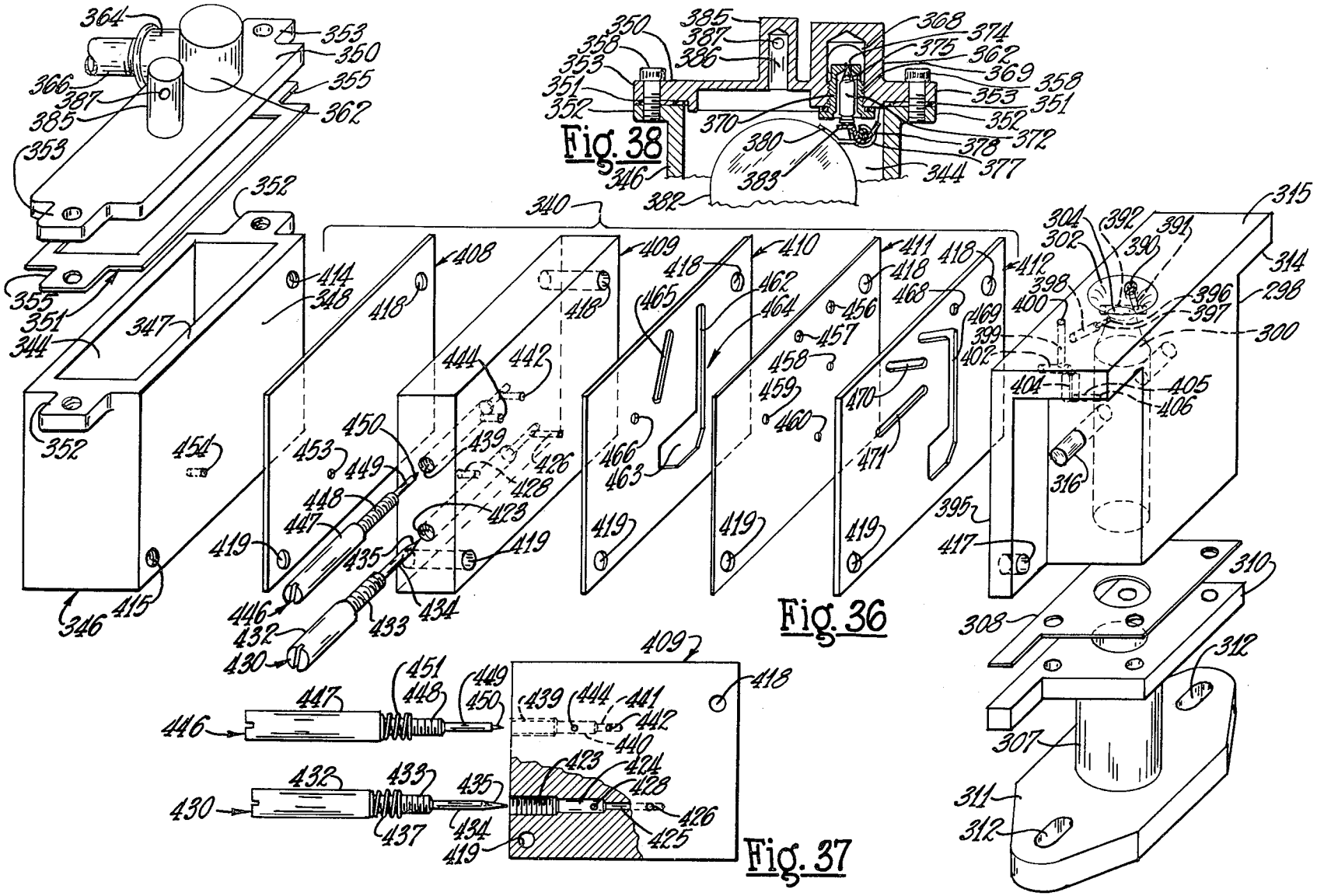
FIG. 36 is an expanded view of the components of the construction shown in FIG. 30.
FIG. 37 is an elevational view partly in section of one of the components illustrated in FIG. 36.
FIG. 38 is a fragmentary sectional view taken substantially on the line 38—38 of FIG. 30.

Associated with the body construction 298 is a fluid flow control system, arrangement or construction 340 which is inclusive of plural laminates, laminar members or components, these components being illustrated in expanded disassembly in FIG. 36. The fluid flow control system or arrangement 340 is inclusive of several laminates, laminar components, plate-like members or elements having perforate pattern regions or open areas providing fluid flow passages or channels for conveying fuel or air for mixing with fuel or for conveying a fuel and air mixture or emulsion for delivery through aperture means, orifices or nozzles opening into the mixing passage 300. The fluid flow control system, arrangement or construction will be hereinafter described in further detail.

The fluid flow control construction, arrangement or assembly 340 comprising laminar means, plurality of laminations, members or components receives fuel from a regulated fuel supply in the chamber or fuel cavity 344 in a second body member or bowl 346. In the embodiment illustrated, liquid fuel from a fuel tank or fuel pump flows into the chamber 344, the fuel flow into the chamber 344 being regulated or controlled by a float-actuated valve means hereinafter described.

The body member or bowl 346 is provided with a cover 350, a gasket 351 being disposed between the upper edges of the side walls of the member 346 and the cover member 350. The bowl or member 346 is provided with projections or ears 352, the cover member provided with projections 353, and the gasket 351 provided with projections 355. The projections are fashioned with registering openings to receive securing screws 358, the openings in the projections 352 being threaded to receive screws 358 for securing the gasket 351, cover 350 and float bowl or body 346 in assembled relation.

The cover member is fashioned with an upwardly extending portion 362 having a lateral portion 364 integral therewith, the portion 364 being bored and threaded to accommodate a tubular means or pipe 366 adapted to be connected with a fuel tank, fuel pump or other fuel source.

As shown in FIG. 38, the portion 362 is fashioned with a bore 368 in communication with the bore in the laterally extending portion 364. A portion of the wall of the bore 368 is threaded as at 369 to receive a valve guide or valve cage 370, the guide having a hollow interior accommodating a relatively movable or slidable fuel inlet valve 372. The upper end of the valve guide has a fuel inlet port 374 opening into the bore 368 in portion 362. The inlet valve 372 has a needle valve portion 375 cooperating with the fuel port 374 for regulating flow of fuel into the fuel chamber 344.

The inlet valve guide or cage 370 is provided with a pair of ears or ear portions 377, one of which is shown in FIG. 38, the ear portions supporting a fulcrum pin 378, as shown in FIG. 38. An arm or member 380 is fulcrumed on the pin 378 for pivotal movement. Secured to the arm 380 is a float or float member 382 disposed in the fuel chamber 344. The arm or lever 380 is fashioned with a portion 383 adapted for engagement with the lower end of the fuel inlet valve member 372.

When the float 382 is in a low position, the needle valve 375 is lowered to open the port 374 whereby fuel from a tank or fuel pump flows into the chamber 344. The incoming fuel elevates the float 382 until portion 383 of member 380 exerts upward force on the valve body 372 and the needle valve portion 375 whereby the latter seats in the port 374 and interrupts flow of fuel into the chamber 344 when the fuel reaches a predetermined level.

The level of the fuel supply in the chamber or reservoir 344 and its relation to the operation of the fuel flow control system or arrangement will be hereinafter described. The cover member 350 has a projection 385 formed with a passage 386 opening into the chamber 344, a wall of the projection having an opening 387 for venting the fuel chamber 344.

Figure 35:
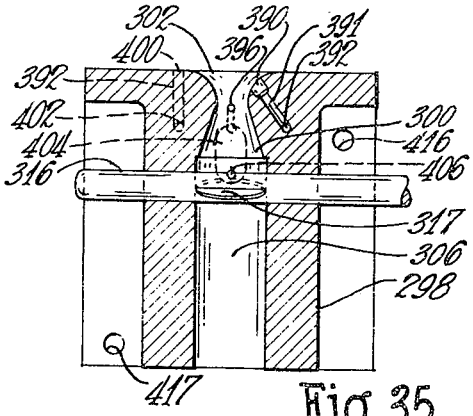
FIG. 35 is a sectional view taken substantially on the line 35—35 of FIG. 30.
Figure 30:
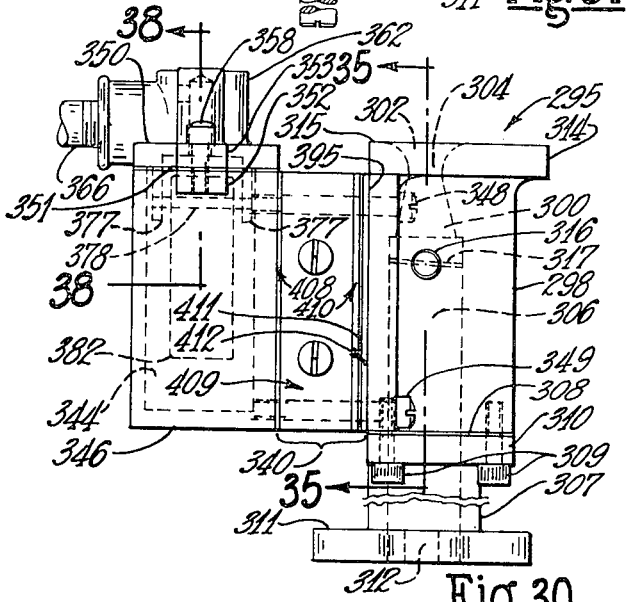
FIG. 30 is a side elevational view of a charge forming apparatus embodying another form of the invention.
Figure 32:
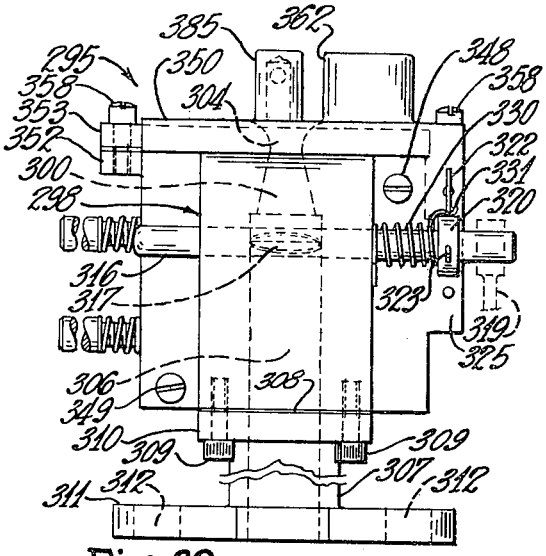
FIG. 32 is a front view of the construction shown in FIG. 30.
Figure 33:
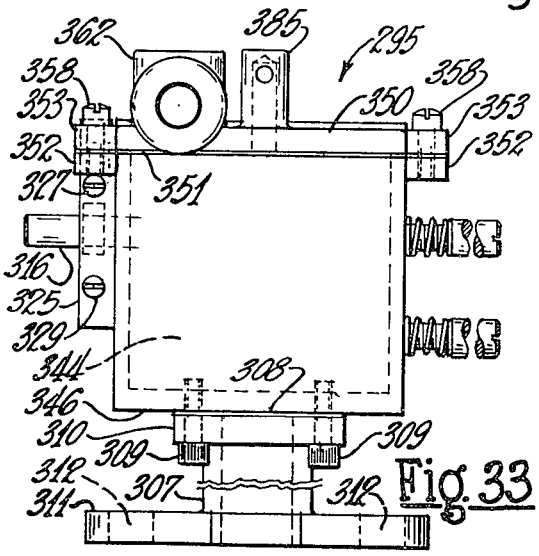
FIG. 33 is a rear view of the construction shown in FIG. 30.

With reference to FIGS. 35 and 36, the carburetor body member 298 is fashioned with an air bleed inlet 390 opening into the ramp or toroidal-shaped air inlet region 302 of the Venturi 304. The air bleed inlet 390 is in communication with a passage 391 which is in communication with a passage 392 opening at the rear surface or face 395 of the body member 298. A restricted passage 397 is in communication with a passage 398 which opens at the surface 395. The passage 397 opens into the restricted region or choke band of the Venturi and provides the main orifice or aperture means 396.

An air passage 399 has an entrance opening 400 at the upper surface 315 of the flange 314. The passage 399 is in commmunication with a passage 402 opening at the surface 395 of the body 298. Fashioned in the body 298 and opening at the surface 395 is an elongated recess, channel or supplemental chamber 404 in communication with a passage 405 which opens into the mixing passage adjacent the throttle valve 317, the open end of the passage 405 being a fuel delivery aperture means or orifice 406 for engine idling and low speed operation.

Fuel is delivered to the fluid flow control system or arrangement 340 from a regulated or controlled liquid fuel supply in the chamber 344, the fluid flow control system or arrangement 340 comprising plural components, laminates or laminar members in stacked or laminated relation and assembly. The fuel is contained in the chamber or reservoir 344 provided by the second body member, component or bowl 346.

Figure 39:
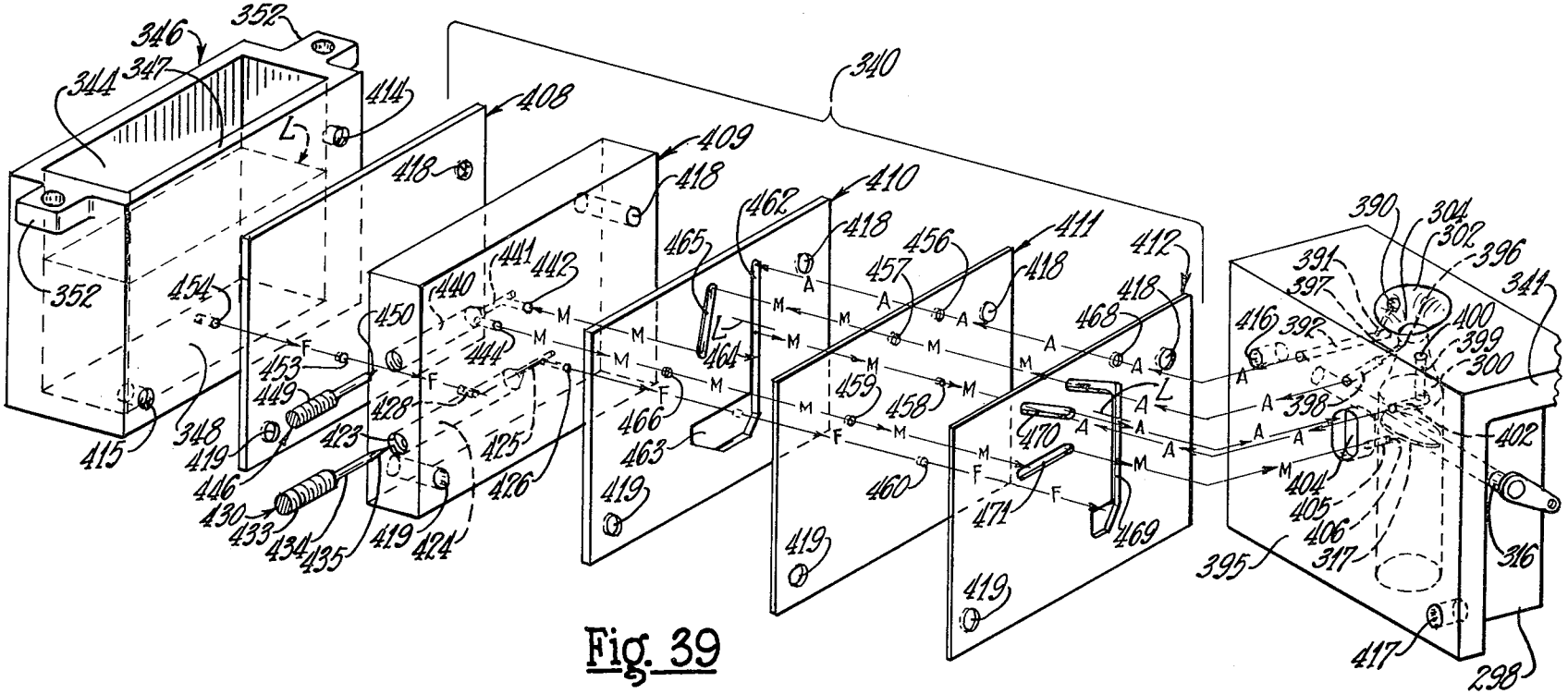
FIG. 39 is an isometric view of components of the construction shown in FIG. 30 in disassembled expanded relation illustrating paths of fluid flow in a dependent system during engine idling operation.
Figure 40:
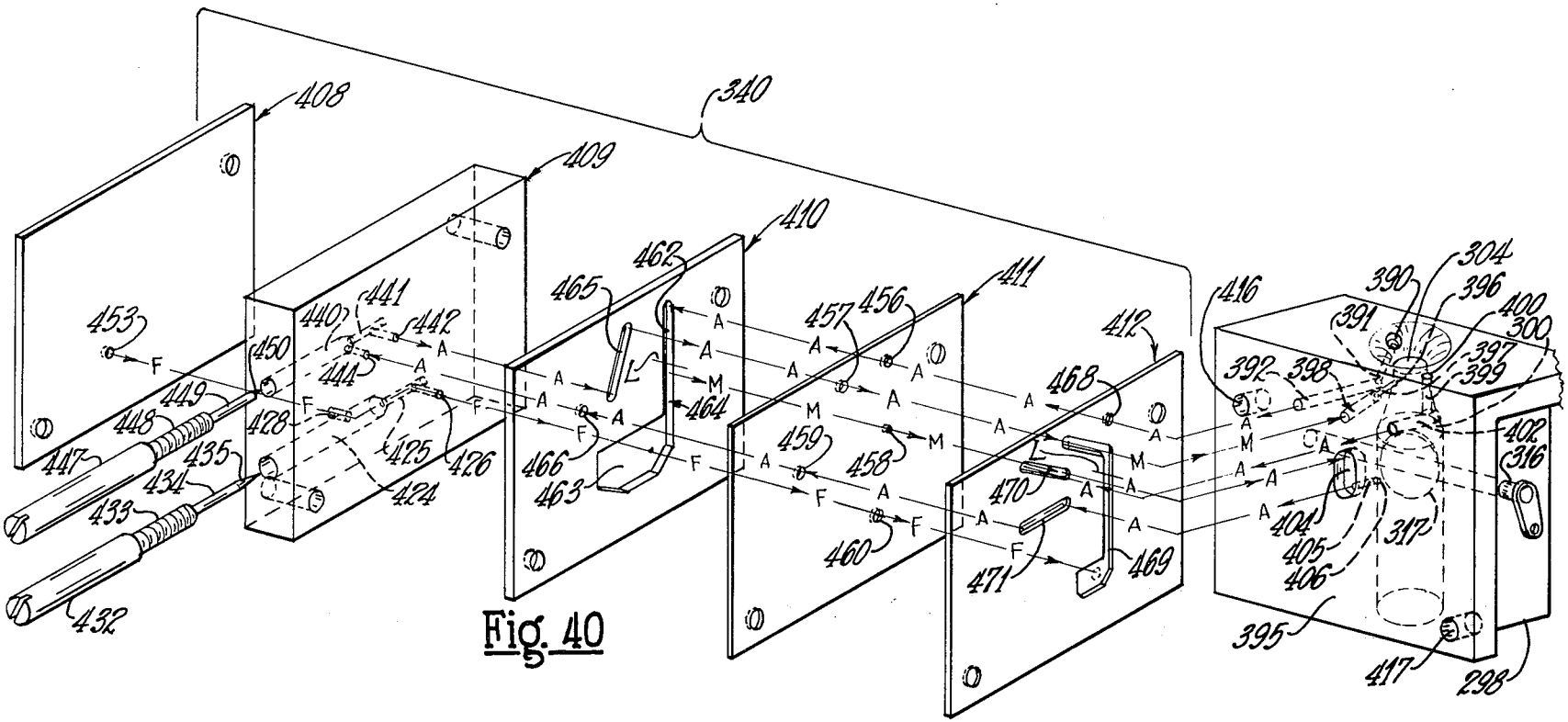
FIG. 40 is an isometric view of components of the fluid flow control system of FIG. 30 illustrating paths of fluid flow in a dependent system during high speed operation.

The fluid flow control system or arrangement 340 includes fluid flow control components, planar or laminar members or laminates 408, 409, 410, 411 and 412 illustrated in FIGS. 36, 39 and 40. The laminar members or laminates 409 and 411 are preferably fashioned of metal, the component 411 containing metering or restrictor passages being fashioned of a metal, such as stainless steel, which is resistant to wear by fluid flowing through the passages or perforate areas in this component. Should the metering passages become enlarged by wear, the metering characteristics of the carburetor may be impaired.

The wall 347 of the body 346 is fashioned with threaded openings 414 and 415 and the main body 298 is provided with openings 416 and 417. Each of the laminar members, laminates or components 408 through 412 is provided with a first opening 418, and a second opening 419. When the first body member or body 298 is assembled with the five components 408 through 412 and with the second body member or body 346 containing the fuel supply chamber 344, the opening 416 in the body 298, all of the openings 418 and the threaded opening 414 are in aligned registration and receive a screw or threaded member 348, shown in FIGS. 30 and 32, the threaded portion of the screw extending into the threaded opening 414.

In assembly, the opening 417 in the body 298, the threaded opening 415 in the body 346 and the openings 419 in the fluid flow control laminar members or components are in aligned registration and receive the threaded member or screw 349. When the screws 348 and 349 are drawn up, the several components are securely held in assembled fluid-tight relation as shown in FIGS. 30 through 34.

The fluid flow control components, plates or laminar members 408 through 412 are fashioned with perforate pattern regions or portions providing open areas or passages accommodating fluid flow. Some of the passages accommodate air flow, some accommodate fuel flow and some accommodate a mixture or emulsion of air and fuel. In the embodiment illustrated, the control component or lamination 409 is provided with passages and manually adjustable valve or flow restrictor means for regulating fluid flow. The arrangement of passages or passage means in the member 409, illustrated in FIGS. 36, 39 and 40, is of a character wherein fuel from the supply in the chamber 344 flows past a high speed adjusting valve means or restrictor including fuel for engine idling and low speed operation.

For engine idling and low speed operation, fuel flowing past the high speed adjusting valve means is thereafter air bled or mixed with air to form an emulsion which is controlled or regulated by an engine idling and low speed valve means or restrictor. The fluid flow control member or laminate 409 is fashioned with a threaded bore 423 in communication with a bore 424, the bore 424 being in communication with a restricted passage 425 and the latter being in communication with a transverse passage 426.

A transverse passage 428 opens into the bore 424, shown in FIG. 37, and receives fuel from the supply. A valve means or restrictor 430 is adapted to regulate fuel flow through the restricted passage 425. The valve means 430 is inclusive of a valve body 432 having a threaded portion 433 adapted to be received in the threaded bore 423 in member 409. The valve body 432 is fashioned with a tenon portion 434 terminating in a needle valve portion 435 which, in assembly, extends into the restricted passage 425 for restricting, regulating or adjusting fuel flow through the passage 425.

A coil spring 437 surrounds the threaded portion 433 which, in assembly, is compressed to provide friction retaining the valve means in adjusted position. The needle portion 435 extends into the restricted passage 425 providing for regulated fuel flow past the needle valve 435.

The member 409 is fashioned with a second threaded bore 439 in communication with a bore 440. The bore 440 is in communication with a restricted passage 441, the latter being in communication with a transverse passage 442. A second passage 444 is in communication with the bore 440. A second valve means or restrictor 446 is adapted to regulate fluid flow through the restricted passage 441. The valve means 446 is inclusive of a valve body 447 having a threaded portion 448 adapted to be received in the threaded bore 439.

The valve body 447 is fashioned with a tenon portion 449 terminating in a needle valve portion 450 which, in assembly, extends into the restricted passage 441 for restricting, regulating or adjusting fluid flow through the passage 441. A coil spring 451 surrounds the threaded portion 448 which, in assembly, is compressed to provide friction retaining the valve means 446 in adjusted position. The needle portion 450 extends into the restricted passage 441 providing for regulated fluid flow past the needle valve 450.

Disposed between the component or member 409 and a planar surface 348 of the member 346 is the component or laminate 408 of comparatively thin, fibrous gasket material. In assembly, the component or laminate 408 is in contiguous engagement with the member 409 and the surface 348 of the body 346 to provide a fluid tight seal. It is to be understood that the component 408 may be made of other suitable gasket or sealing material.

As one function of component or laminate 408 is to effect a sealed joint, the component is of a thickness in a range of 10 thousandths of an inch to 30 thousandths of an inch and is preferably about 20 thousandths of an inch in thickness. The component 408 is provided with a perforation or passage 453 which registers with the passage 428 in component 409 and with a passage 454 in the wall 347 of the body 346 whereby fuel from the chamber 344 flows through the registering passages 454, 453 and 428 into the bore or passage 424 in the component 409.

The component 409 may be of a thickness sufficient to accommodate the threaded portions 433 and 448 of the valve means or restrictors 430 and 446. In the embodiment illustrated, the thickness of the component 409 is about ½ inch but may be ⅜ of an inch or less if desired. The component 409 is preferably made as a die casting of metal such as an alloy containing aluminum or an alloy containing zinc, or this component may be made of stainless steel, brass, aluminum or the like. The component 409 may be of molded resinous material such as Teflon (tetrafluoroethylene resin), Kel-F (monochlorotrifluoroethylene), Delrin (polyoxymethylene) or the like.

The fluid flow control component or laminate 411 is provided with passages or openings accommodating fluid flow, this component or laminate being preferably of metal, such as carbon steel, stainless steel or the like to resist wear by reason of fluid flow through the passages or orifices. The component or plate 411 is herein referred to as metering plate as the passages or perforations in this plate determine fluid flow rates and volumes of fluids, viz. liquid fuel, air for mixing with fuel or a mixture or emulsion of fuel and air. In the embodiment illustrated, the plate is provided with five fluid flow passages, perforations or orifices 456, 457, 458, 459 and 460. The flow paths of fluids through these passages or orifices are hereinafter described in connection with the fluid flow diagrams of FIGS. 39 and 40. The edges of the passages or perforations 456, 457, 458, 459 and 460 may be slightly beveled or chamfered to approach a Venturi shape for facilitating fluid flow.

Disposed between the component or laminate 409 and the component or laminate 411 is a fluid flow control component, plate or laminate 410. The component 410 is provided with an open area or perforate region comprising a vertically disposed passage or open area 462 in communication with an enlarged trapezoidal-shaped open area 463, the open areas 462 and 463 providing a fuel well 464. The component 410 is provided with an elongated channel or passage 465 and a passage or orifice 466.

The fuel well 464, provided by the open areas 462 and 463, receives fuel through flow paths hereinafter described. During operation, air for bleeding with fuel is admitted to the upper end of the vertical channel portion 462 of the fuel well or chamber 464 forming a fuel and air mixture or emulsion for delivery into the mixing passage 300. The lamination or component 412 is fashioned with a circular perforation or passage 468 and elongated perforations, open areas or fluid flow passages 469, 470 and 471.

The fluid flow paths of the fluid flow control system or arrangement above described during engine idling operation are illustrated schematically in FIG. 39. In reference to the fluid flow paths indicated by lines in FIG. 39, the letter "A" indicates air flow; the letter "F" indicates fuel flow and the letter "M" indicates flow of a mixture or emulsion of fuel and air, viz. air-bled fuel in the flow passages in the components or laminates of the fluid flow control system 340.

The fluid flow control lines or paths indicated in FIG. 39 illustrate air flow and fuel flow in supplying an emulsion or mixture of fuel and air, viz. air-bled fuel through the passage 405 adjacent the near closed throttle valve 317 and through the aperture means or orifice 406 for engine idling operation through the use of a so-called dependent system, viz. a system wherein the fuel for both engine idling and high speed engine operation flows past the main adjusting needle valve means or restrictor 435. The fuel and air mixture or emulsion for engine idling purposes is controlled or regulated by a supplemental adjustable needle valve means or restrictor 450 shown in FIGS. 36, 37 and 39.

During engine idling operation, a mixture or emulsion of fuel and air is delivered through the passage 405 and the engine idling aperture means or orifice 406 into the mixing passage 300. Fuel from the supply in the chamber 344 of the body 346 flows through passage 454 in the wall 347 of the member or bowl 346, through passage 453 in component 408 and through passage 428 in component 409 into the bore 424. Fuel from bore 424 flows past the high speed adjusting needle valve or restrictor 435 through the restricted passage 425 and transverse passage 426 in the component 409.

Passage 426 is in registration with the portion 463 of the fuel well 464 in the laminate or component 410 which is in registration with a passage 460 in the component or laminate 411, these passages and well 464 providing a fuel flow path into the lower region of a supplemental well or passage 469. As illustrated in FIG. 39, the normal fuel level in the chamber 344 is indicated at "L" and the same level indicated at "L" in the vertical channel portion 462 of the fuel well 464 in component 410 and at "L" in the supplemental well 469 in component 412.

During engine idling operation, substantial reduced pressure or suction in the mixing passage is existent in the idling orifice passage 405 with the throttle in near closed or engine idling position. The reduced pressure or suction is effective to flow air into the entrance orifice 390 through passages 392, 468 and 456 to the upper end of the vertical well portion 462. The air aspirates some fuel from the well portion 462 and the emulsion of fuel and air flows in a right-hand direction through passage 458 into an intermediate region of the supplemental well 469.

Suction or reduced pressure at the engine idling orifice 406 is effective to convey atmospheric air through passages 397 and 398 to the upper end of the supplemental well 469 for mixing with the emulsion from the passage 458.

The flowing air is effective at the upper end of the well 469 to aspirate fuel from the well 469, the resulting mixture of fuel and air or emulsion flowing in a left-hand direction through passage 457 in the component 411 into and through the passage 465 in the component 410, through the transverse passage 442 in the component 409 into passage 441 and past the engine idling adjusting valve means or needle 450 into passage 444. The valve or restrictor 450 is adjusted to regulate flow of the mixture of fuel and air or emulsion for engine idling purposes.

The mixture or emulsion from passage 444 flows in a right-hand direction through passage 466 in component 410, passage 459 in component 411, into the elongated passage 471 in component 412, thence into the vertically elongated recess or slot 404 in the body 298 and through engine idling passage 405 and orifice 406 into the mixing passage 300.

Additional air for the engine idling emulsion or fuel and air mixture is provided as follows: The reduced pressure or suction in chamber or recess 404 effects air flow into the entrance 400 and through passage 399 in the body 298, through passage 402 in a left-hand direction to an elongated passage 470 in the component 412. The air then flows in a right-hand direction from passage 470 into the recess 404 in the body 298, in which recess the added air is mixed with the fuel and air mixture or emulsion and emulsion or mixture delivered through passage 405 and orifice 406 into the mixing passage for engine idling.

FIG. 40 is an expanded disassembled view of the components of the fluid flow control system and arrangement 340 illustrating fluid flow paths during high speed engine operation. During high speed engine operation, substantial reduced pressure or suction is effective on the main orifice or aperture 396 opening into the Venturi 304 to effect delivery of air-bled fuel, fuel and air mixture or emulsion into the mixing passage. Fuel from the fuel chamber 344, shown in FIG. 39, flows through passage 454 in a right-hand direction through passage 453 in component 408 and through passage 428 into the bore 424 in component 409. The fuel from 424 flows past the high speed adjusting needle valve or restrictor 435 through the restricted passage 425 and passage 426 into the well portion 463 in component 410. Fuel from the well portion 463 flows through passage 460 in component 411 into the supplemental well or fuel channel 469.

The suction or reduced pressure at the main orifice 396 is effective through the engine idling fuel delivery passage 405 in the recess 404 to cause air flow from the mixing passage through the engine idling orifice 406 and recess 404 into the passage 471 in component 412 thence through passage 459 in the component 411, passage 466 in component 410, passage 444 in the component 409 and into the bore 440, past the needle valve or restrictor 450 through the restricted passage 441, through passage 442 into passage 465 in component 410, thence through passage 457 in component 411 into the upper end of the supplemental well 469 in the component 412.

This air mixes with fuel in the well 469 whereby a fuel and air mixture or emulsion is delivered to passage 398 in the body 298 for delivery into the Venturi through the main orifice or aperture means 396 provided by the outlet of passage 397. It is also desirable to further air bleed the main nozzle or passage 397 and this is accomplished as follows: By reason of the aspiration effective at the main orifice 396, air enters the air entrance 390 at the ramp of the air inlet region of the Venturi. Air entering the entrance 390 flows through passages 391 and 392 in the body 298, through the passage 468 in component 412, passage 456 in component 411 into the upper region of the passage 462 of the well 464.

The level "L" of the fuel is indicated on the well portion 462. Aspiration at the main orifice causes the air in the upper region of the well portion 462 to aspirate fuel from the well 464 so that a fuel and air mixture or emulsion flows through the metering orifice 458 in the component 411 thence into an intermediate region of the supplemental well 469. The air flowing from passage 465 in component 410 and through passage 457 in component 411 further air bleeds the fuel and air mixture flowing from the upper portion of the supplemental well 469 into the passage 398 in the body 298 thence through the fuel passage 397 and is delivered through the main orifice 396 into the Venturi of the mixing passage for high speed engine operation.

As the engine increases in speed, the fuel in the well 464 and in the well 469 may be lowered by reason of aspiration of the fuel by air flow above described. Atmospheric air entering the opening 390 in the ramp of the air entrance region of the Venturi flows into the upper end of the well portion 462 to mix with the fuel therein to promote acceleration as the throttle is moved toward open position. The passage 458 in the metering plate or component 411 is effective to introduce air into the fuel passage or well 469 when the level of the fuel in the wells falls appreciably at open throttle engine operation.

The reduced pressure or suction at the idle mixture delivery passage 405 during high speed engine operation is effective to set up some air flow entering the orifice 400 in the body 298, thence through passages 399 and 402 in a left-hand direction into the passage 470 in the component 412. Air from this passage 470 then flows in a reverse or right-hand direction into the recess 404, this action functioning in a measure to stabilize air flow at the region of the recess 404.

The metering characteristics of the carburetor may be varied or modified by employing fluid flow control components having perforations, passages or wells of different cross sectional areas to modify or vary the flow of both fuel and air or a mixture or emulsion of fuel and air. The cross sectional areas of openings or passages in a component may be varied by changing the perforate pattern portions of a component or the widths of open areas or passages or by utilizing a component of a different thickness.

The relative position of the passage 458 in the component 411 is a typical example for modifying the metering or operational characteristics of the carburetor. The passage 458 may be disposed at various vertical positions in the metering plate or component 411 for registration with the vertical well portion 462 and the supplemental well 469 as indicated by the flow path or line in FIG. 39 and in FIG. 40. Where the passage 458 is above the normal level of fuel in the well 464 and the supplemental well 469, the suction or reduced pressure from the Venturi is transmitted to the supplemental well 469 and aspirates fuel from the supplemental well.

Hence, the passage 458 being above normal fuel level, further air is bled from the upper region of the well portion 462 through passage 458 into an upper region of the supplemental well 469 from which the emulsion of fuel and air so formed is delivered through the main orifice 396 into the Venturi of the mixing passage, thus providing a more lean mixture.

If the passage 458 in the metering plate 411 is below fuel level, then the reduced pressure or suction in the supplemental well 469 is proportionately stronger as there is no air bleeding or reduced air bleeding, the fuel being drawn directly from the supplemental well 469. The passage 458 may be provided at various vertical positions and where such positions are below normal fuel level, it is possible through the particular position of the passage 458 to readily control the amount of fuel that is drawn from the fuel well before the fuel is leaned out or mixed with air which flows from the upper region of the well portion 462 through the passage 458 into the well 469.

Another factor for modifying the metering characteristics resides in enlarging or reducing the volume of the fuel wells 464 and 469 to thereby vary the rapidity or flow rate of the fuel delivered into the mixing passage and vary the extent of air bleeding of the fuel. The sizes or volumes of the fuel wells 463 and 469 are rendered variable by simply exchanging components or laminations 410 and 412, and the relative position of the passage 458 is rendered variable by exchanging component or laminate 411 for another having passage 458 in a different location.

It is preferable to utilize components or laminates of minimum thickness which will provide passages of a width or dimension for the necessary fluid flow capacity so as to reduce the cost of the components. The following are examples of materials and thicknesses of the components in the embodiments herein described. The component 408 is of fibrous or other suitable gasket material to provide sealing characteristics in engagement with the body 346 and the component 409.

Hence, this gasket may be comparatively thin, being in a range of thickness of about 15 thousandths of an inch to 30 thousandths of an inch, and is preferably of a thickness of 20 thousandths of an inch. The component 409, equipped with the adjustable needle valves or restrictors 435 and 450, may be in a range of from 5/16 of an inch to ½inch or more in thickness, the thickness being dependent upon the diameters of the threaded portion 433 and 448 of the restrictors.

The component 409 illustrated is about one-half inch in thickness. While it is preferable that the component 409 be fashioned of metal, it is to be understood that this component may be fashioned of suitable resinous material such as Delrin (polyoxymethylene), Teflon (polytetrafluoroethylene) or the like.

Component 410 is fashioned of fibrous gasket material or the like in order to effect a seal with components 409 and 411. The component 410 may be thicker than the component 408 as it is fashioned with open areas 462, 463 providing a fuel well 464, an appreciable thickness being desirable to provide the requisite volumetric open areas or perforations. The component 410 should be of a thickness in a range of 40 thousandths of an inch and 80 thousandths of an inch and is preferably of a thickness of about 57 thousandths of an inch as incorporated in the fluid flow control arrangement shown in the drawings.

The component 411 constitutes a metering plate or member and is fashioned of metal, such as stainless steel or the like, to resist abrasive action of flow of fluids through passages, metering perforations or orifices in the component. The component 411 may be comparatively thin, being preferably of a thickness in a range of 20 thousandths of an inch and 40 thousandths of an inch. In the embodiment illustrated, the component 411 is of a thickness of about twenty-seven thousandths of an inch.

The component 412 is of fibrous gasket material or other suitable material of a character to establish a seal with the component 411 and the surface 395 of the carburetor body 298. The component 412 is of a thickness to provide cross sectional perforated pattern regions or portions having sufficient volumetric spaces to accommodate fluid flow requirements. The component 412 may be of a thickness in a range of 40 thousandths of an inch and 80 thousandths of an inch and is preferably of a thickness of about 57 thousandths of an inch.

Thus, in the embodiment illustrated, the total thickness of the assembled or stacked components of the fluid flow control system or arrangement 340 wherein each component is of the above specified preferred thickness, is slightly more than 21/32 of an inch. It is to be understood, however, that the fluid flow control components may be varied in thickness whereby the thickness of the assembly or stack of components may be of a lesser or greater dimension. In a carburetor body having a mixing passage of larger size or increased flow capacity, the dimensions of the fluid flow control components and the fluid flow passages therein may be modified to accommodate increased fluid flow.

It is to be understood that interchangeable components may be provided for any or all of the components 408 through 412 so as to vary, change or modify the fluid flow or metering characteristics for a particular carburetor. Through the use of interchangeable laminates or laminar-like components, the metering or fluid flow characteristics of the carburetor may be varied within wide limits simply by interchanging one or more fluid flow control components having perforate regions, passages or open areas of different configurations or cross sections.

The fluid flow paths through the passages or perforations of the fluid flow control laminates or laminar members for engine idling operation and high speed engine operation with a dependent system have been illustrated in FIGS. 39 and 40 and hereinbefore described. When the throttle valve 317 is partially opened establishing intermediate engine speed, the flow control paths are modified whereby an emulsion or mixture of fuel and air is delivered into the mixing passage through the main orifice or aperture 396 and through the low speed orifice 406 shown in FIGS. 39, 40 and 43.

With reference to FIG. 40, the fluid flow paths for intermediate engine operation are as follows: Fuel from the chamber 344 flows into the wells 464 and 469. Reduced pressure effective at the main orifice or outlet 396 of passage 397 sets up reduced pressure or suction causing air flow into the opening 390 in the body 298, through passages 391 and 392 in the body, through passage 468 in component 412, passage 456 in component 411 to the upper end of the well portion 462.

The flowing air aspirates fuel from the region 462 of the well 464, and the air-bled mixture or emulsion flows in a right-hand direction from the well portion 462 through the metering passage 458 in component 411 and into a vertical portion of the supplemental well 469 at a region below the upper end of the well. The emulsion or mixture of fuel and air, with additional fuel aspirated from the supplemental well 469, flows to the upper end of the supplemental well 469 thence in a right-hand direction through the passages 398 and 397 and is delivered through the main orifice 396 into the restricted portion of the Venturi in the mixing passage.

During intermediate engine operation, an emulsion of fuel and air is delivered through the engine idling aperture or orifice 406. Fuel from the fuel chamber 344 flows into the wells 464 and 469. An emulsion or fuel and air mixture flows from the upper end of the supplemental well 469 through passage 457 in component 411 to the upper end of an elongated passage or channel 465 in the component 410.

The emulsion flows from the lower end of the channel 465 in a left-hand direction through passages 442, 441 in the component 409 and past the needle valve or restrictor 450. The emulsion then flows in a right-hand direction, as viewed in FIG. 40, through passage 466 in component 410, passage 459 in component 411 and into one end of the elongated passage or channel 471 in component 412. The emulsion flows from the other end of channel 471 in a right-hand direction through the recess 404 and is delivered through the passage 405 and engine idling orifice 406 into the mixing passage 300.

The reduced pressure or suction established in the recess 404 by aspiration on the low speed orifice 406 is effective to cause atmospheric air to flow into the inlet 400 of passage 399, through passage 402 and in a left-hand direction to one end of the elongated channel or passage 470 in component 412. The air flows from the other end of channel 470 in a right-hand direction into the elongated recess 404, and this air mixes with the air and fuel emulsion from the channel 471 in component 412 thus further leaning the mixture delivered through the engine idling orifice 406 into the mixing passage.

The explanation and description of fluid flow paths during engine idling operation, intermediate engine speed operation and high speed operation have been hereinbefore set forth as being exemplary of operational characteristics at these engine speeds. It is to be understood that for various increments of opening of the throttle valve 317 under different load conditions, that the amount of fuel, or emulsion of fuel, or the amount of air bled into the fuel providing the emulsion for delivery through the aperture means or orifices 396 and 406 into the mixing passage will necessarily be varied. Hence, during engine operation, an enrichened emulsion for acceleration purposes may, under certain conditions, be delivered into the mixing passage and, under other conditions, a more lean emulsion may be delivered into the mixing passage.

Thus, the metering or operating characteristics of the carburetor embodying the fluid flow control system or arrangement may be changed or modified by varying the perforate patterns or regions in the laminar members or laminates to secure desired metering or fluid flow characteristics promoting efficient operation of the carburetor throughout all engine speeds.

Figure 41:
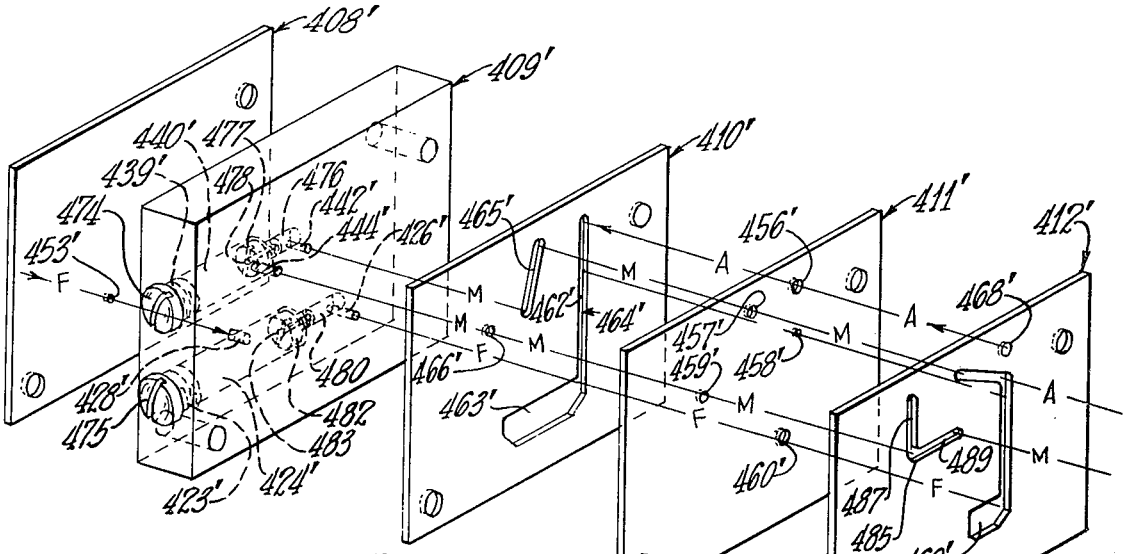
FIG. 41 is an isometric view of components of the fluid flow control system similar to FIG. 40 having passages or fluid flow paths embodying fixed metering orifices for fluid delivery for idling and normal engine operation.

FIG. 41 illustrates the arrangement of fluid flow control components, laminates or plate-like members wherein the fuel for delivery to the carburetor is metered by fixed restrictor means, orifices or passages in lieu of the adjustable metering needle valves or restrictors 435 and 450 shown in FIGS. 36, 37, 39 and 40. The arrangement illustrated in FIG. 41 is inclusive of fluid flow control components 408′, 409′, 410′, 411′ and 412′. The components 408′ and 410′ are substantially identical with components 408 and 410. The metering plate 411′ and the plate 412′ have different perforate pattern portions or regions of open areas or passages than the components 411 and 412.

The component 409′ is substantially the same as the component 409 but without adjustable valve means. Threaded into the bore 439′ is a plug or closure 474, and threaded into the bore 423′ is a plug or closure 475. In this form of the invention, in lieu of the restricted passage 441 shown in FIG. 37, a passage 476 forming a continuation of the bore 440′ is threaded to accommodate a threaded fitting or bushing 477, the bushing having a fixed restrictor, metering passage or orifice 478 to meter the flow of fluid.

In lieu of the restricted passage 425, shown in FIG. 37, a passage 480 forming a continuation of the bore 424′ is threaded to accommodate a threaded fitting or bushing 482 having a fixed restrictor means, metering passage or orifice 483 to meter the flow of fluid. The fluid flow control laminar member 408′ has a fuel passage 453′ which registers with passage 428′ in component 409′.

The air flow paths, the fuel flow paths and the mixture flow paths in the arrangement shown in FIG. 41 under engine idling conditions are similar to the flow paths illustrated in FIG. 39 and hereinbefore described. Air for mixing with fuel flows from the exterior air bled passage 391, shown in FIG. 39, through passage 468′ in component 412′, through passage 456′ in component 411′ to the upper end of the vertical portion 462′ of the well 464′ in the component 410′.

Fuel from the fuel chamber 344, shown in FIG. 39, flows through passage 454 in the chamber wall and through passage 453′ in the component or laminar member 408′ and through passage 428′ in the laminar member or component 409′ and into the bore 424′. The fuel in the bore 424′ flows through the fixed restrictor means or passage 483 in the fitting or bushing 482, through passages 480 and 426′ into the fuel well portion 463′ of the well 464′ in component 410′. The fuel well 463′ registers with passage 460′ in the component or laminar member 411′, fuel from the well flowing through the passage 460′ in laminar member 411′ into the supplemental fuel well or chamber 469′ in laminar member 412′.

Air flows through the main orifice or aperture means 396 provided by the passage 397 opening into the Venturi, shown in FIG. 39, through passages 397 and 398 in the body 298 into the upper end of the supplemental fuel well 469′ where the air flow aspirates fuel from the well 469′. This air bled fuel, emulsion or mixture flows through passage 457′ in laminar member 411′ to the upper end of the elongated passage 465′ in laminar member 410′.

The mixture flows from the lower end of passage 465′ through passage 442′ in laminar member 409′ and through the restrictor means or fixed orifice 478 in the fitting or bushing 477, thence in a right-hand direction through passage 444′, through passage 466′ and passage 459′ in laminar member 411′ into the apex region 485 of a V-shaped passage in laminar member 412′.

One leg 487 of the V-shaped perforate pattern or passage receives exterior air through the connecting passages 399 and 402 in the carburetor body 298, shown in FIG. 39, this air mixing with the fuel and air mixture or emulsion at the apex region 485. This mixture or emulsion is further air bled from air in the leg or passage 487 which flows through the leg or passage portion 489, thence in a right-hand direction through passage 405, shown in FIG. 39, and is delivered into the mixing passage through aperture means or orifice 406 for engine idling purposes.

For high speed engine operation, the flow paths for fuel, air and an emulsion of fuel and air are substantially the same as the flow paths for high speed operation illustrated in FIG. 40.

Figure 42:
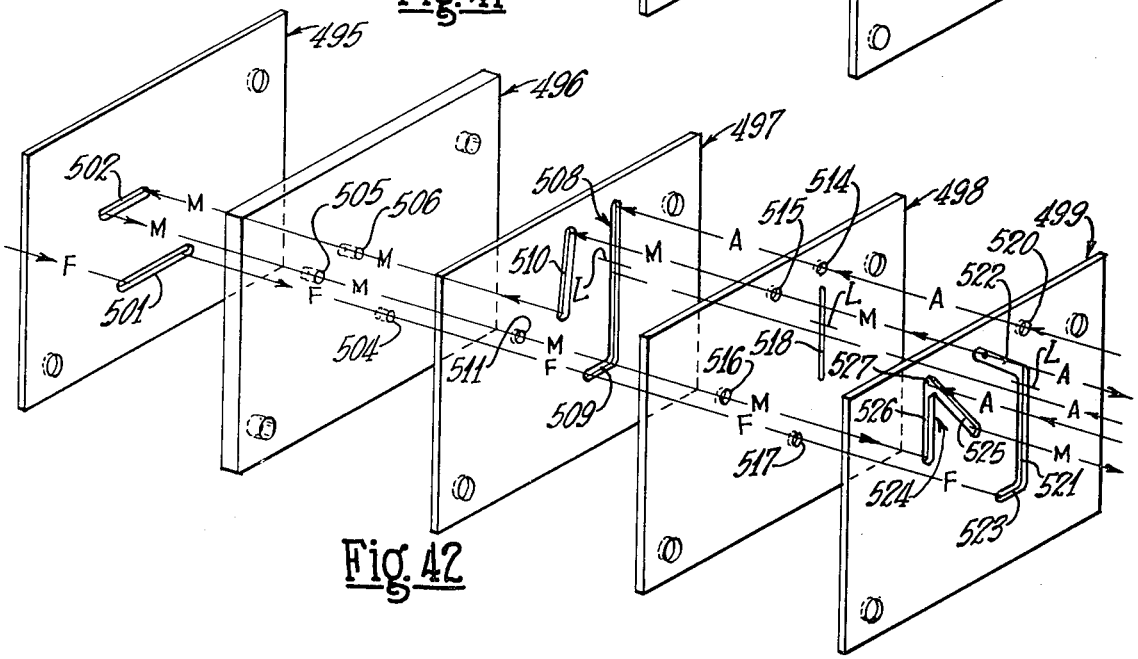
FIG. 42 is a view similar to FIG. 41 illustrating another arrangement of fixed orifices for fluid delivery for idling and normal engine operation.

FIG. 42 illustrates an arrangement of fluid flow control components, laminates or laminar members wherein the perforate pattern portions or regions of open areas, passages or channels are provided utilizing fixed passages, orifices or restrictor means for metering flow of fluids in the fluid flow control system. The arrangement illustrated in FIG. 42 is inclusive of fluid flow components or laminar members 495, 496, 497, 498 and 499 which correspond generally with the respective components 408 through 412 hereinbefore described.

The laminar member or laminate 495 has a perforate region which includes a first elongated perforation or passage 501, one end of the passage being in communication with the passage 454 in a wall of the float bowl or body member 346 shown in FIGS. 36 and 39. The laminate 495 is fashioned with a second elongated perforation or passage 502. The laminar member or laminate 496 is fashioned with restrictor perforations or passages 504, 505 and 506. The passages or restrictors 504, 505 and 506 are of a size or dimension to meter or restrict fluid flow without utilizing adjustable means.

The laminar member 497 has perforate regions or portions including a vertically elongated perforation providing a fuel well 508 having a lower horizontal portion 509, an elongated perforation or passage 510 and a circular perforation or passage 511. The laminar member or metering plate 498 has perforate pattern regions or portions including circular perforations or passages 514, 515, 516 and 517, and a vertically elongated perforation or passage 518.

The laminar member or component 499 has perforate pattern regions or portions including a circular perforation or passage 520, a supplemental fuel well 521 having an angular elongated upper portion 522 and a lower portion 523. The laminar member 499 has a V-shaped perforation or passage 524 including a leg portion 525, a second leg portion 526, the leg portions converging at an apex region 527.

The fluid flow paths for engine idling operations of the dependent system embodying a fixed orifice metering arrangement illustrated in FIG. 42 are as follows: The throttle 317 is in near closed or engine idling position and engine operation sets up substantial reduced pressure or suction on the engine idling orifice 406 and the passage 405, shown in FIGS. 36, 39 and 40. The reduced pressure or suction is effective to cause fuel flow from the fuel chamber 344 through the passage 454 in the wall 347 of the fuel chamber.

The passage 454 registers with the passage 501 in the laminar member 495 and fuel flows into this passage. Fuel from the passage 501 flows through passage 504 in the laminar member 496, through the lower portion 509 of well 508, through passage 517 in laminar member 498 and into the lower portion 523 of the supplemental well 521. Air enters through the main orifice 396 in the body 298 shown in FIGS. 36 and 39 and flows to the upper region of the supplemental fuel well 521 and aspirates fuel from the supplemental well 521 to form an emulsion.

The emulsion or fuel and air mixture from the upper region 522 of the supplemental well 521 flows in a left-hand direction through the passage 515 in the member 498 and into the upper end of the elongated passage 510 in the member 497. The mixture or emulsion flows from the lower end of the passage 510 in a left-hand direction through fixed passage or restrictor 506 in the member 496 into one end of the elongated passage 502 in the member 495.

As the member 495 is in fluid tight engagement with the surface 348 of the body 346, shown in FIGS. 36 and 39, the emulsion in passage 502 flows in a right-hand direction through the fixed metering passage or restrictor 505 in the member 496, through passage 511 in the member 497, through passage 516 in member 498 into the lower end of the leg 526 of the inverted V-shaped passage in member 499.

Air from passages 399 and 402 in the body 298, shown in FIGS. 36, 39 and 40, flows in a left-hand direction into the apex region 527 of the inverted V-shaped passage or perforation 524. The fuel and air mixture or emulsion entering the leg 526 is further air bled or leaned by air at the apex region 527 and the emulsion or fuel and air mixture thus formed flows from the leg 525 of the passage 524 in a right-hand direction into the elongated recess 404 and passage 405 in the body 298, shown in FIGS. 39 and 40, and through the aperture or orifice 406 into the mixing passage for engine idling purposes.

The emulsion or fuel and air mixture is metered by the fixed restrictors or passages 505 and 506. As the laminar member 496 is provided with fixed flow restrictors, the member may be of lesser thickness than the corresponding component 409, shown in FIG. 39.

The fluid flow paths for a high speed engine operation of the fluid flow control system shown in FIG. 42 are modified in certain respects from the operation of the fluid flow control system shown in FIG. 41 in that under certain operating conditions there is increased air bleeding into the fuel before the emulsion or mixture of fuel and air is delivered into the Venturi of the mixing passage. In high speed operation, the throttle valve 17 is in open position or near open position with high aspiration effective on the main nozzle 396 in the body 298.

The aspiration or reduced pressure is effective to cause air flow through the entrance 390 into passages 391 and 392 in the body 298. The air flows in a left-hand direction from passage 392 through passage 520 in member 499, passage 514 in member 498 into the upper end of the well 508. The normal level of fuel in the wells 508 and 521 and in the vertical passage 518 in member 498 is indicated at "L." The suction or reduced pressure at the main orifice 396 causes the air in the upper region of the well 508 to aspirate fuel from the well, and the emulsion or mixture flows in a right-hand direction from the intermediate region of the well 508 through the vertical passage 518 in member 498 into an intermediate region of well 521, thence from the region 522 of well 521 through passages 398 and 397 and through the main orifice 396 into the choke band region of the Venturi. The aspiration of fuel out of the wells 508 and 521 lowers the fuel level in the wells and in the vertical passage 518 in the member 498.

As the fuel is lowered, more air mixes with the fuel as more air flows from the upper region of the well 508 through the passage 518 in member 498 into the supplemental well 521. In the arrangement shown in FIG. 42, the lower region 509 of the fuel well 508 is of lesser volume than the fuel well portion 463, shown in FIGS. 36, 39 and 40, whereby at high engine speed the fuel flows directly from passage 504 in the member 496 through well portion 509 of the well 508 into the lower end region 523 of the fuel well 521.

The fuel is thus air bled from the air in the well 508 and air entering the supplemental well 521 from the passages 399 and 402, shown in FIGS. 36, 39 and 40, providing a relatively lean mixture flowing from the upper region of 522 of the well 521 to the main fuel delivery orifice 396. The fuel level in the wells 508 and 521 is comparatively high during engine idling operation and, when the throttle is opened, the initial mixture of fuel and air or emulsion delivered from the wells 508 and 521 through the main fuel delivery orifice 396 is comparatively rich in fuel and provides an accelerating mixture for the engine.

By reason of the vertical elongation of the passage 518 in the member 498 as the fuel level is progressively lowered, more air from the upper region of the fuel chamber 508 is bled into the fuel and leans the mixture at increased engine speeds. Thus, it will be seen that through the provision of the vertically elongated passage 518 in the member 498 and the reduced volume of the lower region 509 of the well 508, a control over the amount of air bled into the mixture may be had for modifying the metering characteristics of the carburetor.

Figure 43:
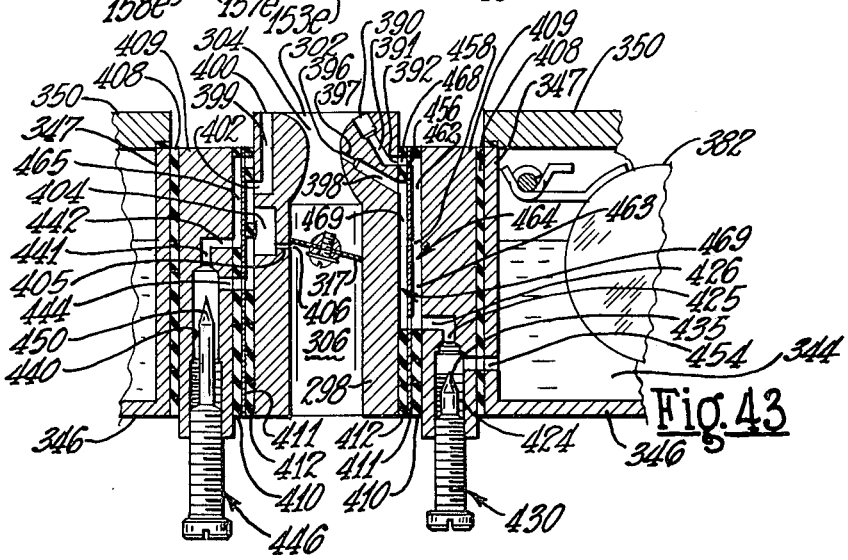
FIG. 43 is a schematic sectional view illustrating the fluid flow channels in the fluid flow control system illustrated in FIG. 36.
Figure 31:
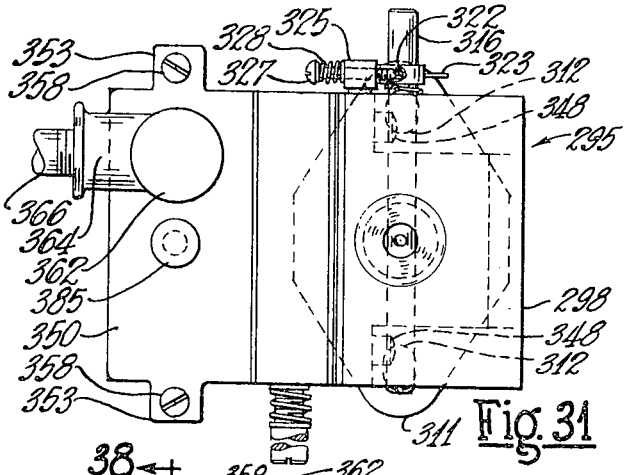
FIG. 31 is a top plan view of the construction shown in FIG. 30.

FIG. 43 is a schematic cross sectional illustration to show the relationship of the several components, laminar members or laminates in assembled relation and to schematically illustrate the adjustable restrictor means 430 and 446 in the component 409. From the illustration in FIG. 43, it will be seen that the perforations or passages in the several laminar members or laminations of the fluid flow control system are comparatively short, the laminar members providing a very compact arrangement receiving fuel from the supply chamber 344 in body member 346 wherein the fuel level is regulated by the float-controlled valve means 372, shown in FIG. 38.

FIG. 44 is an expanded isometric view of disassembled fluid flow control components, laminar members or laminates having perforate pattern regions or passages wherein the fuel for engine idling purposes is metered or controlled independently of the fuel for high speed engine operation, such arrangement being referred to as an independent idle system. In FIG. 44, the fluid flow control laminar members or laminates are designated 538, 539, 540, 541 and 542. The body 298 is of the same construction shown in FIGS. 30 through 36, 39 and 40. In FIG. 43, the fluid flow passages are shown on opposite sides of the body for clarity of illustration whereas, in fact, passage 465 communicates with passage 469 as hereinbefore described in connection with FIG. 39.

The body includes a mixing passage 300, a throttle shaft 316 supporting a throttle valve 317, the mixing passage having a Venturi 304 and fuel delivery aperture means including a main fuel delivery orifice 396 and an engine idling orifice 406. The main fuel delivery orifice 396 is the outlet of passage 397 in communication with passage 398. The engine idling orifice 406 is the outlet of passage 405 in communication with an elongated chamber or recess 404.

An air entrance 390 in the ramp region of the Venturi is in communication with passages 391 and 392, and the air inlet opening 400 is in communication with passages 399 and 402. The body member 346 providing the fuel supply chamber 344 has a fuel passage 454 in the wall 347 of the body. In assembled relation, the first and second body components 298 and 346 and the several fluid flow laminar members or laminates are secured together by screws 348 and 349 in the manner illustrated in FIGS. 30 through 34.

In the arrangement illustrated in FIG. 44, the laminar member or laminate 538 is fashioned with an elongated perforation or passage 544. The member 539 has a passage 545 opening into a threaded bore 546 which receives an adjustable needle valve or restrictor means 548. The needle valve portion 549 of the restrictor means 548 cooperates with a restricted passage 550, the latter being in communication with a passage 551. The laminar member 540 has a perforate pattern region or portion including a fuel well 553 having an enlarged lower region or chamber 554 and an elongated passage 555 fashioned with an angular lower portion or leg 556.

The laminar member 541 is fashioned with perforated pattern regions or portions including perforations or circular passages 558, 559, 560, 561 and 562. The laminar member 542 is fashioned with perforated regions which include a circular passage or perforation 564, a supplemental fuel well or passage 565 having an upper angular region 566 and a lower chamber 567, an elongated perforation or passage 569 and a second elongated perforation or passage 570.

The laminar member 539 has passage means accommodating flow of fuel for high speed engine operation independent of flow of fuel for engine idling operation. The member 539 is fashioned with a passage 573 in registration with passage 544 in member 538, the passage 573 opening into a threaded bore 576 accommodating an adjustable valve means or restrictor 577, the restrictor having a needle valve portion 578. The bore 576 is in communication with a restricted passage 580 which is in communication with a passage 581.

The needle valve portion 578 of the restrictor 577 cooperates with the restricted passage 580 to regulate or control fuel flow for high speed engine operation. The body components or members 298 and 346 and the laminar members or fluid flow control components 538 through 542 in assembled relation provide flow paths or passages for fluids such as air, fuel and a mixture or emulsion of fuel and air.

The fluid flow lines in FIG. 44 indicate flow paths of air, fuel and a mixture or emulsion of fuel and air of the independent engine idling system wherein the control of fuel for engine idling operation is independent of the control of fuel for high speed engine operation. The paths of flow of fluids indicated in FIG. 44 for engine idling operation are as follows: During engine idling operation, a mixture or emulsion of fuel and air is delivered through the passage 405 and the engine idling aperture means or orifice 406 into the mixing passage 300 in the body 298.

Fuel from the supply in the chamber or cavity 344 of the body member 346 flows through passage 454 in the wall 347 into passage 544 in the member 538. Fuel from passage 544 flows in a right-hand direction through passages 545 in member 539 into the bore 546 and past the restrictor or needle valve 549 into passage 550. Fuel from passage 550 flows through passage 551 in a right-hand direction into an intermediate region of the elongated passage 555 in member 540.

Under the influence of reduced pressure on the engine idling orifice 406, air from the Venturi region of the mixing passage 300 flows in a left-hand direction through the main orifice or aperture 396, through passages 397 and 398 in the body member 298, through the upper region 566 of the supplemental well 365 in member 542, through passage 559 in member 541 into the upper region of the elongated passage 555 in member 540. Thus, fuel flow into the intermediate region of passage 555 and the air flow into the upper end of passage 555 is established by the high suction or reduced pressure on the engine idling orifice 406 with the throttle valve 317 in near closed or engine idling position.

The air in the upper region of the passage 555 mixes with the fuel entering the intermediate region of the passage 555 and the resulting mixture or emulsion of fuel and air flows in a right-hand direction from the angular leg portion 556 of the passage 555 in member 540, through passage or perforation 561 in the member 541 and into an end region of the elongated passage 570 in member 542. The mixture or emulsion flows from passage 570 in a right-hand direction into the supplemental chamber or recess 404 in the body 298.

Additional air for bleeding or mixing with the emulsion in recess 404 is derived from air entering the opening 400 in the body 298, the additional air flowing through passages 399 and 402 into one end region of the passage 569 in member 542, the air then flowing from passage 569 in a right-hand direction into the supplemental chamber or recess 404 further leaning the mixture or emulsion in the recess. The leaned emulsion so formed flows through the passage 405 and is delivered through the aperture 406 into the mixing passage at the downstream side of the throttle valve 317 for engine idling operation.

The arrangement of carburetor body construction and fluid flow components shown in FIG. 45 is substantially identical with the arrangement of carburetor body construction and fluid flow components of FIG. 44, FIG. 45 having lines indicating flow paths of fluids for high speed engine operation utilizing the system wherein the control of fuel for engine idling operation is independent of the control of fuel for high speed engine operation.

During high speed engine operation, substantial reduced pressure or suction is effective upon the main orifice or aperture 396 to effect delivery of air bled fuel or emulsion into the mixing passage. Under the effect of the reduced pressure, fuel from the supply in the fuel chamber 344 flows through passage 454 in a right-hand direction through passage 544 in component 538 and through passage 575 into the bore 576 in the member 539 which accommodates the adjustable valve or restrictor 577.

The fuel in the bore 576 flows past the needle portion 578 of the valve means 577 into the restricted passage 580 and through the passage 581 into the enlarged region or chamber 554 of the well 553 in the component 540, thence through the perforation or passage 562 in the component 541 into the lower region or portion 567 of the well 565 in component 542. The normal fuel level in the chamber 344, the well 553 and the supplemental well 565 is indicated at "L."

The suction or reduced pressure at the main orifice 396 is effective to cause air flow for mixing with the fuel through the engine idling orifice 406 and the supplemental chamber or recess 404 in a left-hand direction through passage 471 in member 542, through passage 561 in member 541 into the angular portion 556 of passage 555. The air from passage 555 flows in a right-hand direction through passage 559 in member 541 into the upper region 566 of the well 565 for mixing with the fuel in the well 565. Air for mixing with the fuel also enters the opening 390 in the body 298, the air flowing through passages 391 and 392 in the body 298 through passage 564 in the member 542, passage 558 in member 541 and into the upper region of the fuel well 553.

The flowing air aspirates fuel from the well 553, the air bled fuel or emulsion flowing in a right-hand direction through the passage 560 into the supplemental fuel well 565 in which region the emulsion is further air bled by the air flowing from passage 555 in member 540 through passage 559 in member 541 into the upper region 566 of the supplemental fuel well 565. The resulting air bled mixture flows in a right-hand direction through passages 398 and 397 and is delivered into the Venturi 304 through the main fuel delivery orifice or aperture 396.

The normal fuel level in the well 553 and well 565 is indicated at "L." If the fuel level is above the passage 560 in member 541, the air bled mixture flowing through passage 560 is rich in fuel mixture for acceleration purposes. As the fuel level is lowered in the wells 553 and 565 by increased delivery through the main orifice 396 at increased engine speeds, then air from the upper region of the well 553 flows through the passage 560 in member 541 and further leans the emulsion or mixture in the upper region of the supplemental well 565 so that as the engine approaches high speed operation, the mixture or emulsion is thus further leaned out by air flowing through the passage 560.

It is to be understood that in lieu of the circular metering passage 560 in member 541, the component 541 may be interchanged with a component having the passage 560 at a different level, or interchanged with a member having the vertically elongated passage of the character illustrated at 518 in member 498 in FIG. 42. With a vertically elongated passage, a proportionately greater amount of air is bled into the fuel for high speed engine operation as the level of the fuel is lowered in the fuel wells 553 and 565.

When the engine attains a high speed, fuel flows from passage 581 in component 539 through the lower portion of the well 554 in member 540, through passage 562 in member 541 and into the portion 567 of well 565. In the supplemental well 565, the fuel is mixed with a substantial amount of air so as to provide a proper mixture for high speed engine operation.

It will be apparent that fluid flow control components, laminar members or laminates having different perforate patterns or regions of open areas or passages may be interchanged with the components herein illustrated and described to provide any various metering characteristics of the carburetor. Thus, a fuel enrichened emulsion may be supplied for engine acceleration. A fuel and air mixture or emulsion may be provided with a proper amount of air to secure most efficient operation of the carburetor with a particular engine.

The sizes of the fuel wells may be varied to adapt the calibrations of the carburetor to various applications. A large well may be necessary or desirable for engines that require large amounts of fuel particularly for acceleration purposes. The fuel wells may be reduced or enlarged in volume to provide a proper amount of air bled fuel or emulsion to be delivered to the engine at wide open throttle operation.

A sudden opening of the throttle from engine idling position will establish suction or reduced pressure in the upper part of the supplemental well and in the main well in accordance with the metering restriction in the system substantially exhausting the fuel in the wells and, thereafter at high engine speeds, the fuel is caused to flow from the fuel supply through the fuel passages in the components and the air-bled mixture or emulsion delivered from the upper region of the supplemental well through the main orifice into the Venturi of the mixing passage.

During this action, air in the main fuel well aspirates some fuel from the main well and this added emulsion flows to an intermediate region of the supplemental fuel well and is delivered to the main orifice. Hence, by interchanging flow components having different orientations or perforate patterns of open areas providing passages or fuel wells, various metering characteristics for the carburetor may be attained.

As the fluid flow control components are of comparatively thin sheet stock, except the component or laminar member containing the adjustable valves or flow restrictors, interchangeable components may be fashioned at comparatively low cost whereby the body component or member 298 is rendered usable with engines of various sizes and capacities and providing desired metering characteristics for the carburetor under various load and operating conditions.

It is apparent that, within the scope of the invention, modifications and different arrangements may be made other than as herein disclosed, and the present disclosure is illustrative merely, the invention comprehending all variations thereof.

I claim:

1. Charge forming apparatus comprising, in combination, a body construction including a first body member providing a fuel and air mixing passage, a second body member providing a fuel cavity, aperture means opening into the mixing passage, fluid flow control laminar means disposed between the body members having perforate pattern regions providing passages for fuel and air, a flexible diaphragm forming one wall of the fuel cavity, a recess in the second body member, a fuel inlet valve disposed for slidable movement in said recess, and means in the fuel cavity arranged to transmit movements of the diaphragm to the inlet valve for controlling fuel flow into the fuel cavity.

2. Charge forming apparatus comprising, in combination, a body construction including a first body member providing a fuel and air mixing passage, a second body member providing a fuel cavity, aperture means opening into the mixing passage, laminar means disposed between the body members having perforations providing passages for fuel and air for delivery to the aperture means, a flexible diaphragm forming one wall of the fuel cavity, a recess in the second body member, a fuel inlet valve disposed for slidable movement in said recess, means in said fuel cavity arranged to transmit movements of the diaphragm to the inlet valve for controlling fuel flow into the fuel cavity, and restrictor means for regulating fuel flow from the fuel cavity to the aperture means.

3. Charge forming apparatus according to claim 2 wherein the means arranged to transmit movements of the diaphragm to the inlet valve includes a lever pivotally mounted by the second body member, said lever being arranged for operative engagement with the inlet valve, a second recess in the second body member, and resilient means extending into said second recess and engaging the lever for normally biasing the inlet valve toward closed position.

4. Charge forming apparatus according to claim 2 wherein the fluid flow restrictor means are adjustable.

5. Charge forming apparatus according to claim 2 wherein the fuel flow restrictor means are mounted by the second body member.

6. Charge forming apparatus comprising, in combination, a body construction including a first body member providing a fuel and air mixing passage, a second body member providing a fuel cavity, aperture means opening into the mixing passage, said aperture means including a main fuel delivery orifice and an engine idling fuel delivery orifice, fluid flow control laminar means disposed between the body members having perforate pattern regions providing passages for fuel and air, a flexible diaphragm forming one wall of the fuel cavity, a recess in the second body member, a fuel inlet valve disposed for slidable movement in said recess for controlling fuel flow into the fuel cavity, means in the fuel cavity arranged to transmit movements of the diaphragm to the inlet valve for controlling fuel flow into the fuel cavity, a first adjustable restrictor means for regulating fuel flow to the main discharge orifice, and second adjustable restrictor means for regulating fuel flow to the engine idling orifice means.

7. Charge forming apparatus according to claim 6 including an air bypass opening into the mixing passage, and one of the perforate pattern regions of the laminar means providing an elongated air flow channel in communication with said air bypass for admitting air from the mixing passage for mixing with the fuel delivered from the engine idling orifice means.

8. Charge forming apparatus according to claim 6 wherein the second body member has a single fuel flow passage in communication with a second perforate pattern region in said laminar means, said second perforate region in the laminar means being arranged to convey fuel to the region of the first restrictor means regulating fuel flow to the main orifice and for conveying fuel to the region adjacent the second restrictor means regulating fuel flow to the engine idling orifice means.

9. Charge forming apparatus according to claim 6 wherein the first and second adjustable restrictor means are mounted in the second body member.

10. Charge forming apparatus comprising, in combination, a body construction including a first body member providing a fuel and air mixing passage, a second body member providing a fuel cavity, aperture means opening into the mixing passage, fluid flow control laminar means disposed between the body members having perforate pattern regions providing passages for fuel and air, a flexible diaphragm forming one wall of the fuel cavity, said first body member having a chamber, said second body member having a portion extending into the chamber in the first body member, said extending portion having a recess, a fuel inlet valve disposed for slidable movement in said recess for controlling the fuel flow from the chamber into the fuel cavity in the second body member, means in the fuel cavity arranged to transmit movements of the diaphragm to the inlet valve for controlling fuel flow into the fuel cavity, and adjustable valve means mounted by one of said body members for regulating fuel flow to the aperture means.

11. Charge forming apparatus comprising, in combination, a body construction including a first body member providing a fuel and air mixing passage, a second body member providing a fuel cavity, aperture means opening into the mixing passage, said aperture means including a main fuel delivery orifice and an engine idling fuel delivery orifice, laminar means disposed between the body members having perforations providing fluid flow passages, a flexible diaphragm forming one wall of the fuel cavity, a recess in the second body member, a fuel inlet valve disposed for slidable movement in said recess for controlling fuel flow into the fuel cavity, means in the fuel cavity arranged to transmit movements of the diaphragm to the inlet valve for controlling fuel flow into the fuel cavity, an air bypass opening into the mixing passage in said first body member, one of said perforations in said laminar means establishing communication between said air bypass and the engine idling fuel delivery orifice for mixing air with the fuel delivered through the engine idling fuel delivery orifice.

12. Charge forming apparatus according to claim 11 wherein another of the perforations in the laminar means conveys fuel to the main fuel delivery orifice.

13. Charge forming apparatus according to claim 11 wherein the laminar means is interchangeable with laminar means wherein the perforation establishing communication between the air bypass and the engine idling fuel delivery orifice is of different configuration for modifying air flow for mixing with the fuel delivered through the engine idling fuel delivery orifice.

14. Charge forming apparatus according to claim 11 including first adjustable restrictor means for regulating fuel flow to the main fuel delivery orifice, and second adjustable restrictor means for regulating fuel flow to the engine idling orifice means.

15. Charge forming apparatus comprising, in combination, a body construction including a first body member providing a fuel and air mixing passage, a second body member providing a fuel cavity, aperture means opening into the mixing passage, fluid flow control laminar means disposed between the body members having perforate pattern regions providing passages for fuel and air, a flexible diaphragm forming one wall of the fuel cavity, a fuel inlet valve, means in the fuel cavity arranged to transmit movements of the diaphragm to the inlet valve for controlling fuel flow into the fuel cavity, and restrictor means mounted by the second body member for regulating fuel flow from the fuel cavity to the aperture means.

16. Charge forming apparatus, in combination, a body construction comprising a first body member and a second body member, fluid flow control laminar means disposed between the body members, one of the body members having a fuel and air mixing passage, a fuel cavity provided in the second body member, float-controlled valve means associated with the second body member for regulating fuel flow into the fuel cavity, main fuel delivery orifice means in the first body member opening into the mixing passage, supplemental fuel delivery orifice means in the first body member opening into the mixing passage, laminar means disposed between the body members having perforate pattern regions establishing communication of the fuel cavity with the main orifice means and with the supplemental orifice means, air bypass means in the first body member, and perforate pattern regions in the laminar means arranged to convey air from the air bypass means for mixing with fuel providing a fuel and air emulsion.

17. Charge forming apparatus, in combination, a body construction comprising a first body member and a second body member, a fuel and air mixing passage provided in the first body member, a fuel cavity in the second body member, main fuel delivery orifice means in the first body member opening into the mixing passage, supplemental fuel delivery orifice means in the first body member opening into the mixing passage, float-controlled, valve means associated with the second body member for regulating fuel flow into the fuel cavity, a plurality of laminations in contiguous relation disposed between the first and second body members, perforate pattern regions in the laminations establishing communication of the fuel cavity with the main orifice means, perforate pattern regions in certain of said laminations providing passages for conveying fuel to said supplemental orifice means, air bypass means in the first body member, and perforate pattern regions in certain of the laminations arranged to convey air from the air bypass means for mixing with fuel providing a fuel and air emulsion for delivery to the main orifice means and to the supplemental orifice means.

18. Charge forming apparatus, in combination, a body construction comprising a first body member and a second body member, a fuel and air mixing passage provided in the first body member, a fuel cavity in the second body member, main orifice means in the first body member opening into the mixing passage, supplemental orifice means in the first body member opening into the mixing passage, float-controlled valve means associated with the second body member for regulating fuel flow into the fuel cavity, fluid flow control laminar means disposed between said body members, said laminar means comprising plural plate members in contiguous relation, certain of said plural plate members having perforations providing fluid flow passages, the plate member contiguous with the second body member having a perforation in communication with the fuel cavity for conveying fuel to perforations in other plate members for delivery to said main orifice means and said supplemental orifice means in the first body member.

19. Charge forming apparatus according to claim 18 wherein one of the plate members is provided with restrictor means for controlling fuel flow to the main orifice means.

20. Charge forming apparatus according to claim 19 wherein said one of the plate members is provided with a second restrictor means for controlling fuel flow to said supplemental orifice means.

21. Charge forming apparatus according to claim 18 wherein one of the plate members has an elongated perforation providing a fuel well.

22. Charge forming apparatus according to claim 18 wherein another of the plate members is provided with an elongated perforation providing a second fuel well.

23. Charge forming apparatus according to claim 18 wherein each of two of the plate members is provided with an elongated perforation providing a fuel well, means for admitting air to the fuel wells, and a plate member disposed between the plate members having the fuel wells provided with metering orifices for metering mixtures of fuel and air for delivery to the main orifice means and supplemental orifice means.

24. Charge forming apparatus, in combination, a body construction comprising a first body member and a second body member, a fuel and air mixing passage provided in the first body member, a throttle valve in said mixing passage, a fuel cavity in the second body member, main orifice means in the first body member opening into the mixing passage, supplemental orifice means in the first body member opening into the mixing passage, a cover member for the second body member, a relatively movable inlet valve mounted by the cover member, float means in the fuel cavity having operative engagement with the inlet valve for controlling fuel flow into the fuel cavity, a plurality of laminations arranged in stacked relation between the first and second body members, one of said laminations being of greater thickness than the other laminations, said other laminations having perforations providing flow passages for conveying fuel and air mixture for delivery through the main orifice means and the supplemental orifice means, passages in the said lamination of increased thickness accommodating flow of fuel, a first adjustable valve means mounted by the lamination of increased thickness for regulating fuel flow to the main orifice means, and second adjustable valve means mounted by the lamination of increased thickness for regulating flow of fuel to the supplemental orifice means, and means securing the first and second body members and the plurality of laminations in assembled relation.

* * * * *